US009474982B2

(12) United States Patent
O'Connor

(10) Patent No.: US 9,474,982 B2
(45) Date of Patent: Oct. 25, 2016

(54) TOWER TRACK PLAY SET

(71) Applicant: Mattel, Inc., El Segundo, CA (US)

(72) Inventor: Stacy L O'Connor, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 177 days.

(21) Appl. No.: 14/267,182

(22) Filed: May 1, 2014

(65) Prior Publication Data

US 2014/0326798 A1 Nov. 6, 2014

Related U.S. Application Data

(60) Provisional application No. 61/818,636, filed on May 2, 2013.

(51) Int. Cl.
*A63H 18/02* (2006.01)

(52) U.S. Cl.
CPC ..... *A63H 18/028* (2013.01); *A63H 18/026* (2013.01)

(58) Field of Classification Search
CPC ..... A63H 18/026; A63H 18/028; A63H 18/005; A63H 18/04; A63H 17/008; A63H 18/06; A63H 18/08; A63H 18/02; A63F 9/14; A63F 7/3622
USPC ..... 104/53, 60; 446/444, 429, 168, 409, 64, 446/59, 69, 58, 62
See application file for complete search history.

(56) References Cited

U.S. PATENT DOCUMENTS

| | | | | |
|---|---|---|---|---|
| 2,635,877 | A * | 4/1953 | Levenstein | A63F 9/14 119/423 |
| 3,379,440 | A * | 4/1968 | Jaffe | A63F 7/3622 446/168 |
| 3,457,668 | A | 7/1969 | Genin | |
| 3,483,653 | A | 12/1969 | Genin | |
| 3,502,332 | A | 3/1970 | Wolf | |
| 3,658,333 | A | 4/1972 | Carcel | |
| 3,797,164 | A | 3/1974 | Glass et al. | |
| 3,803,756 | A | 4/1974 | Strongin | |
| 4,087,935 | A | 5/1978 | Edmisson et al. | |
| 4,291,878 | A | 9/1981 | Nagel et al. | |
| 4,932,917 | A | 6/1990 | Klitsner | |
| 5,823,848 | A | 10/1998 | Cummings | |
| 6,000,992 | A | 12/1999 | Lambert | |

(Continued)

FOREIGN PATENT DOCUMENTS

| | | |
|---|---|---|
| DE | 2 035 478 | * 1/1972 |
| GB | 1 253 085 | * 11/1971 |

*Primary Examiner* — Mark Le
(74) *Attorney, Agent, or Firm* — Edell, Shapiro & Finnan

(57) ABSTRACT

An improved toy vehicle play set includes a base, a pillar or support, at least one platform, and a retaining mechanism. The pillar is configured to extend substantially vertically from the base. The at least one platform is coupled to the pillar and is configured to receive a toy vehicle. A retaining mechanism coupled to the at least one platform retains the toy vehicle on the platform until actuation of the retaining mechanism. Upon actuation, the retaining mechanism is reconfigured from a retaining configuration that retains the toy vehicle on the platform to a releasing configuration that enables the toy vehicle to roll off of the platform. Where multiple platforms are present, upon actuation, multiple retaining mechanisms are simultaneously reconfigured from a retaining configuration that retain toy vehicles on the multiple platforms to a releasing configuration that enables the toy vehicles to roll off of the platforms.

14 Claims, 19 Drawing Sheets

(56) References Cited

U.S. PATENT DOCUMENTS

| | | | |
|---|---|---|---|
| 6,402,583 | B2 | 6/2002 | Yoneda et al. |
| 7,036,307 | B2 | 5/2006 | Rehkemper et al. |
| 7,160,171 | B1 | 1/2007 | Rehkemper et al. |
| 7,241,223 | B1 | 7/2007 | Caudill |
| 8,016,639 | B2 | 9/2011 | Jobe |
| 8,043,139 | B2 | 10/2011 | Jobe |
| 8,298,038 | B2 | 10/2012 | O'Connor et al. |
| 8,430,712 | B2 | 4/2013 | O'Connor et al. |
| 2002/0034982 | A1 | 3/2002 | Mejia |
| 2006/0286897 | A1 | 12/2006 | Bedford et al. |
| 2012/0220183 | A1 | 8/2012 | Payne |

* cited by examiner

TOWER TRACK PLAY SET

CROSS-REFERENCE TO RELATED APPLICATION

This application claims priority to and is based on U.S. Provisional Patent Application No. 61/818,636, filed May 2, 2013, entitled "Tower Track Play Set," the entire disclosure of which is incorporated by reference herein.

FIELD OF THE INVENTION

The present invention relates to a toy vehicle play set, and in particular, a toy vehicle play set with multiple toy vehicle launching platforms. Specifically, the multiple launching platforms of the present invention include a mechanism for retaining or releasing the toy vehicles from the platforms.

BACKGROUND OF THE INVENTION

Various toy vehicle play sets are known. Many of these toy vehicle play sets include a launch mechanism that is powered to launch a toy vehicle. The launching of a toy vehicle requires various parts that may cause the toy vehicle play set to be expensive to manufacture and purchase. Furthermore, many toy vehicle play sets that do not use a powered launching mechanism require the use of gravity to launch toy vehicles onto tracks.

SUMMARY OF THE INVENTION

Many children desire a toy vehicle play set that launches the toy vehicles in multiple directions simultaneously. Thus, there is a need for a toy vehicle play set that enables toy vehicles to be launched simultaneously. Also, there is a need for a toy vehicle play set that allows toy vehicles to be launched from similar starting spots at the same time. Furthermore, there is a need for a toy vehicle play set with multiple launching mechanisms that are simple and inexpensive. In addition, there is a need for a toy vehicle play set that enables multiple toy vehicles to be launched simultaneously in various directions. Finally, there is a need for a toy vehicle play set that utilizes only one actuator to simultaneously launch multiple toy vehicles in various directions.

In one embodiment, a toy play set for toy vehicles includes a base, a pillar or support, an actuation member, a first platform, and a second platform. The pillar or support extends in a substantially vertical direction from the base. The pillar includes a top and a bottom, and further defines an interior cavity. The actuation member is movably disposed within the cavity of the pillar. The first platform is disposed along the outside of the pillar at a first location, and the second platform is disposed along the outside of the pillar at a second location, which is different than the first location. Additionally, the first platform is configured to launch a toy vehicle in a first direction, and the second platform is configured to launch a toy vehicle in a second direction, which is different from the first direction. Moreover, a first retaining mechanism is pivotally coupled to the first platform while also being coupled to the actuation member. Similarly, a second retaining mechanism is pivotally coupled to the second platform while also being coupled to the actuation member. Both the first and the second retaining mechanisms are reconfigurable between a retaining configuration and a releasing configuration. Thus, movement of the actuation member moves the first retaining mechanism and the second retaining mechanism simultaneously between the retaining configuration and the releasing configuration.

A second embodiment of the toy vehicle play set includes a base, a support extending upwardly from the base, a first platform, a second platform, and an actuation member movably coupled to the support. The first platform is disposed on the support and is configured to launch a toy vehicle in a first direction. The second platform is disposed on the support and is configured to launch a toy vehicle in a second direction, which is different from the first direction. The first platform includes a first retaining mechanism movably coupled thereto. Similarly, the second platform includes a second retaining mechanism movably coupled thereto. Both the first and the second retaining mechanisms are reconfigurable between a retaining configuration and a releasing configuration. Moreover, the actuation member is engaged with the first retaining mechanism and the second retaining mechanism. Therefore, movement of the actuation member moves the first retaining mechanism and the second retaining mechanism simultaneously between the retaining configuration and the releasing configuration.

Another embodiment of the toy vehicle play set includes a base, a support extending upwardly from the base, a first platform, a second platform, and an actuation member movably coupled to the support. The first platform is disposed on the support at a first location and the second platform is disposed on the support at a second location, which is different from the first location. The first platform includes a first retaining mechanism movably coupled thereto. Similarly, the second platform includes a second retaining mechanism movably coupled thereto. Both the first and the second retaining mechanisms are reconfigurable between a retaining configuration and a releasing configuration. Moreover, the actuation member is engaged with the first retaining mechanism and the second retaining mechanism. Therefore, movement of the actuation member moves the first retaining mechanism and the second retaining mechanism simultaneously between the retaining configuration and the releasing configuration.

BRIEF DESCRIPTION OF THE DRAWINGS

Like reference numerals have been used to identify like elements throughout this disclosure.

DETAILED DESCRIPTION OF THE INVENTION

Figure 1:
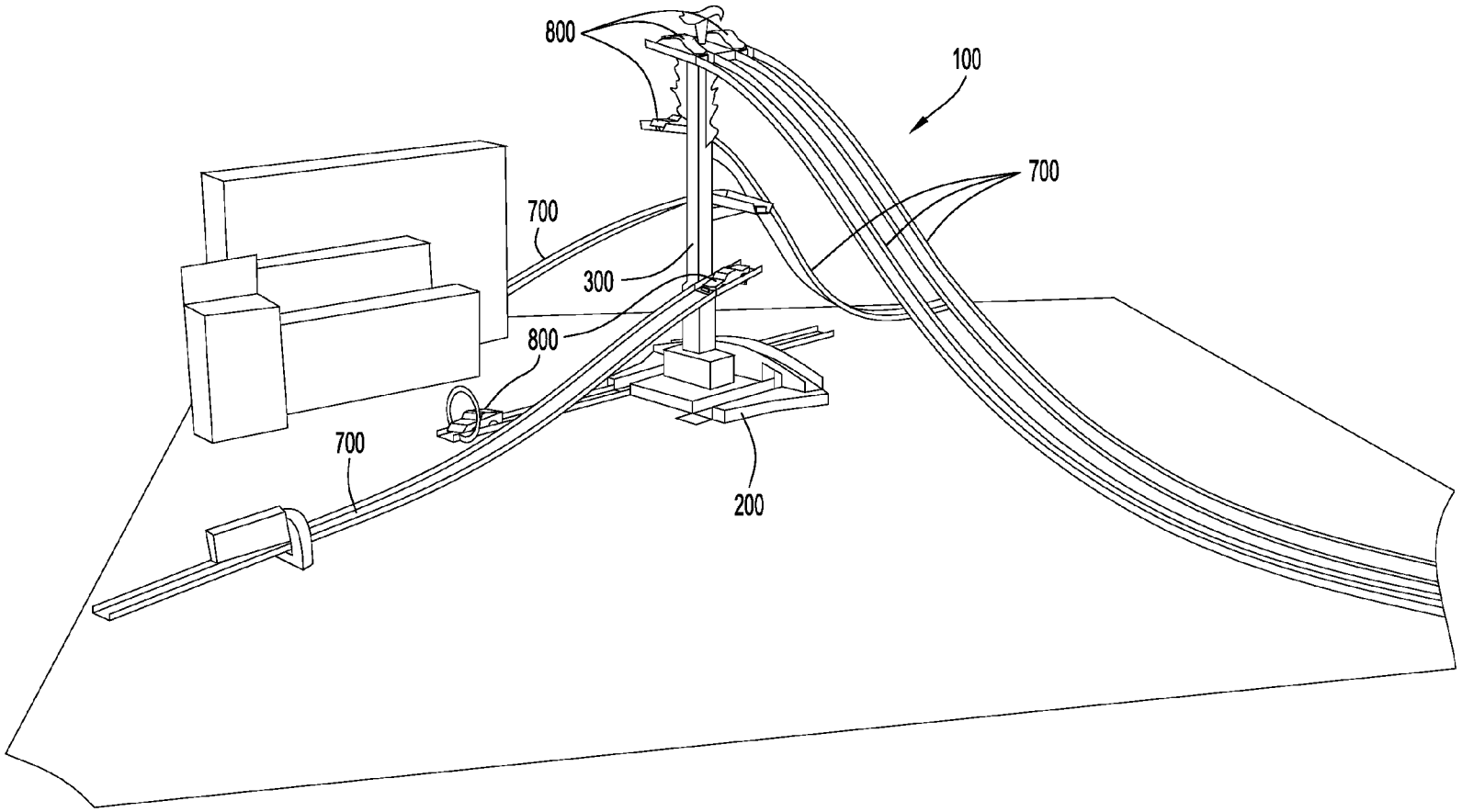
FIG. 1 illustrates a perspective view of a first embodiment of the toy vehicle play set in accordance with the present invention.
Figure 2:
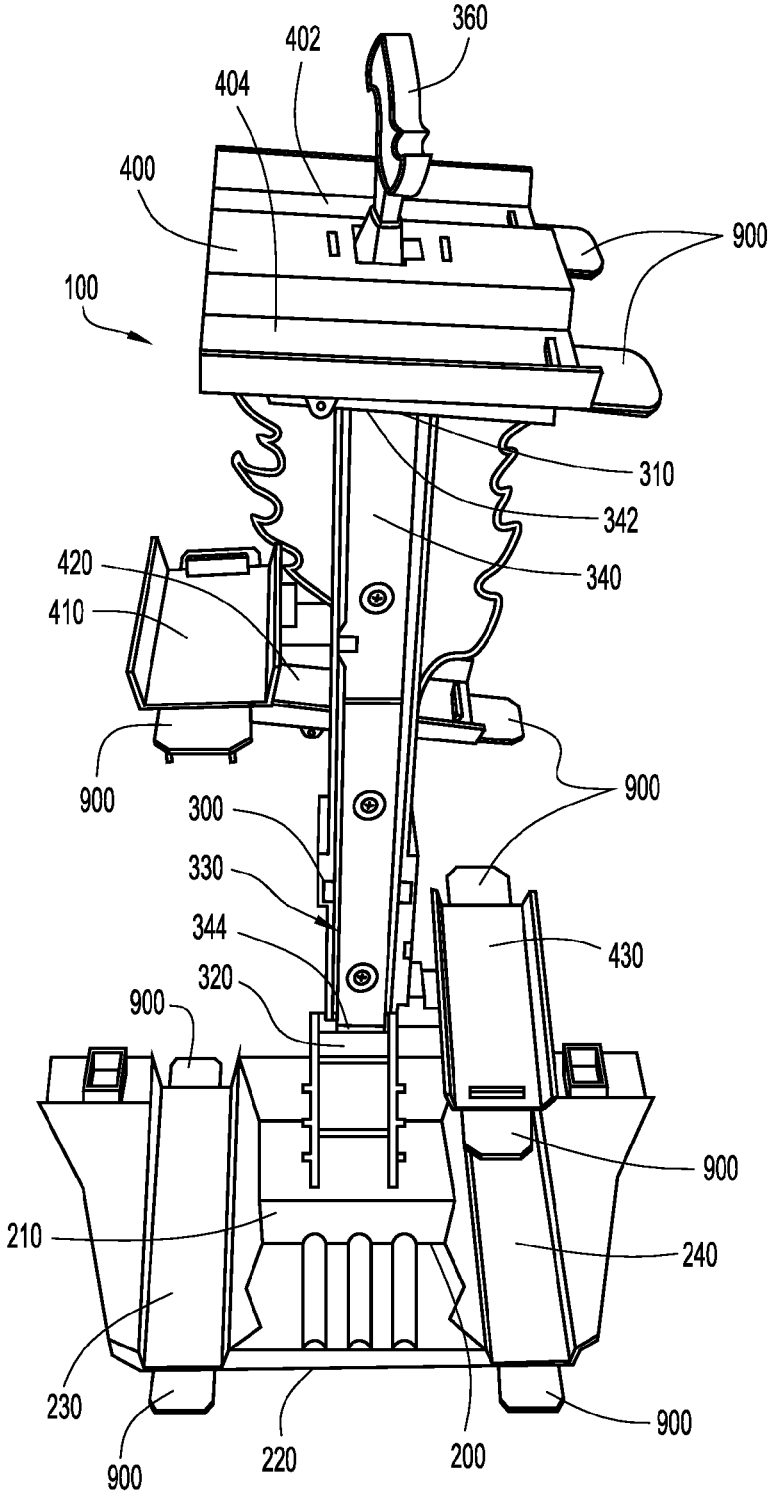
FIG. 2 illustrates a perspective view of the pillar connected to the base according to the embodiment of FIG. 1.

FIGS. 1 and 2 illustrate perspective views of a first embodiment of the toy vehicle play set in accordance with the present invention. The toy vehicle play set 100 includes a base portion 200 and a pillar or support 300. The pillar or support 300 extends in a substantially vertical direction from the base portion 200. As best illustrated in FIG. 2, the base portion 200 includes a top 210 and a bottom 220 (on a side of the base portion 200 opposite to the top 210). According to this embodiment of the toy vehicle play set 100, the top 210 of the base portion 200 includes a first track 230 and second track 240. Each of the first track 230 and the second track 240 includes connection tongues 900 that allow elongated removable track portions 700, illustrated in FIG. 1, to be slidably connected to the first and second tracks 230, 240.

As best illustrated in FIG. 2, the pillar or support 300 includes a top 310 and a bottom 320. The bottom 320 of the pillar 300 is coupled to the top 210 of the base 200. According to this embodiment, the pillar 300 has three sides that define an interior cavity or slot 330. In other embodiments, the interior cavity 330 may be fully enclosed. Within the interior cavity 330 is an actuation plate 340 that slides vertically within the cavity 330 of the pillar 300. The actuation plate 340 includes a top 342 and a bottom 344. As illustrated, the top 342 of the actuation plate 340 is located proximate to the top 310 of the pillar 300, and the bottom 344 of the actuation plate 340 is located proximate to the bottom 320 of the pillar 300. A plunger 360 is coupled to the top 342 of the actuation plate 340 and slides the actuation plate 340 vertically within the interior cavity 330 of the pillar 300.

As seen in both FIGS. 1 and 2, this embodiment of the toy vehicle play set 100 includes four platforms 400, 410, 420, 430 disposed at different locations and at different levels along the outside of the pillar 300. Using the four platforms 400, 410, 420, 430, a child may launch a toy vehicle 800 in one of several different directions away from the pillar 300. The first platform 400 is coupled to the top 310 of the pillar 300. The first platform 400 differs from the other three platforms 410, 420, 430, in that the first platform is designed to hold two toy vehicles 800. Each of the platforms 400, 410, 420, 430 includes upwardly extending sidewalls to hold a toy vehicle 800. The first platform 400 includes a first track slot 402 and a second track slot 404. Each of these track slots 402, 404 has a connection tongue 900 on only one end. The plunger 360 extends through the first platform 400 to the actuation plate 340.

In this first embodiment, the second, third, and fourth platforms 410, 420, 430 are identical to one another. Each of the second, third and fourth platforms 410, 420, 430 includes connection tongues 900 on both ends of the platforms 410, 420, 430. Furthermore, all of the platforms 400, 410, 420, 430 are positioned in different positions and different elevations about the pillar 300, and thus, each platform 400, 410, 420, 430 releases a toy vehicle 800 in a different direction along different elongated removable track portions 700, as best seen in FIG. 1. Furthermore, illustrated in FIG. 1 are toy vehicles 800 placed on the platforms 400, 410, 420, 430 to be released down the elongated removable track portions 700.

Figure 3:
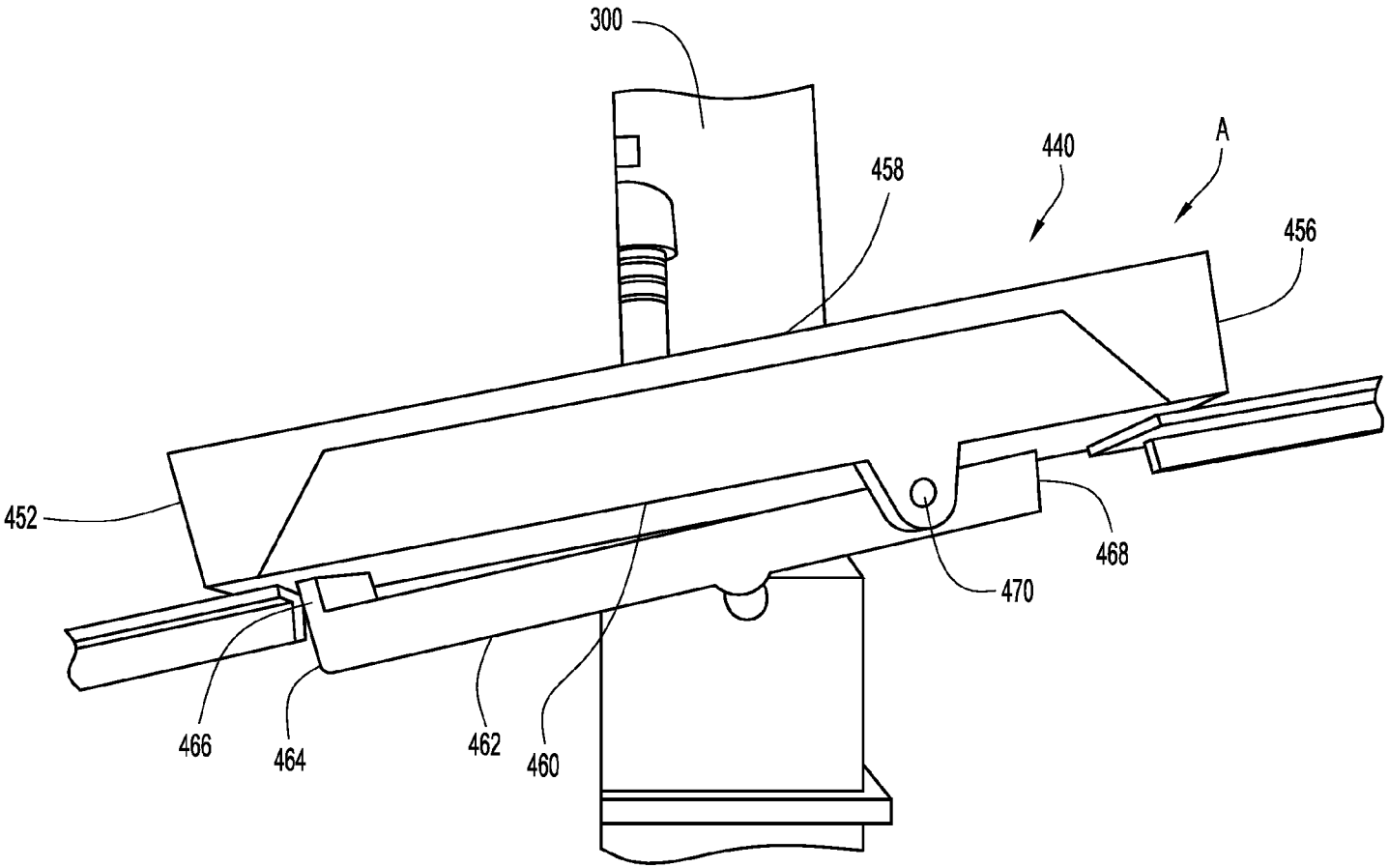
FIG. 3 illustrates a side view of a platform with a retaining mechanism of the embodiment of the toy vehicle play set of FIG. 1, the retaining mechanism being in the retaining configuration.
Figure 4:
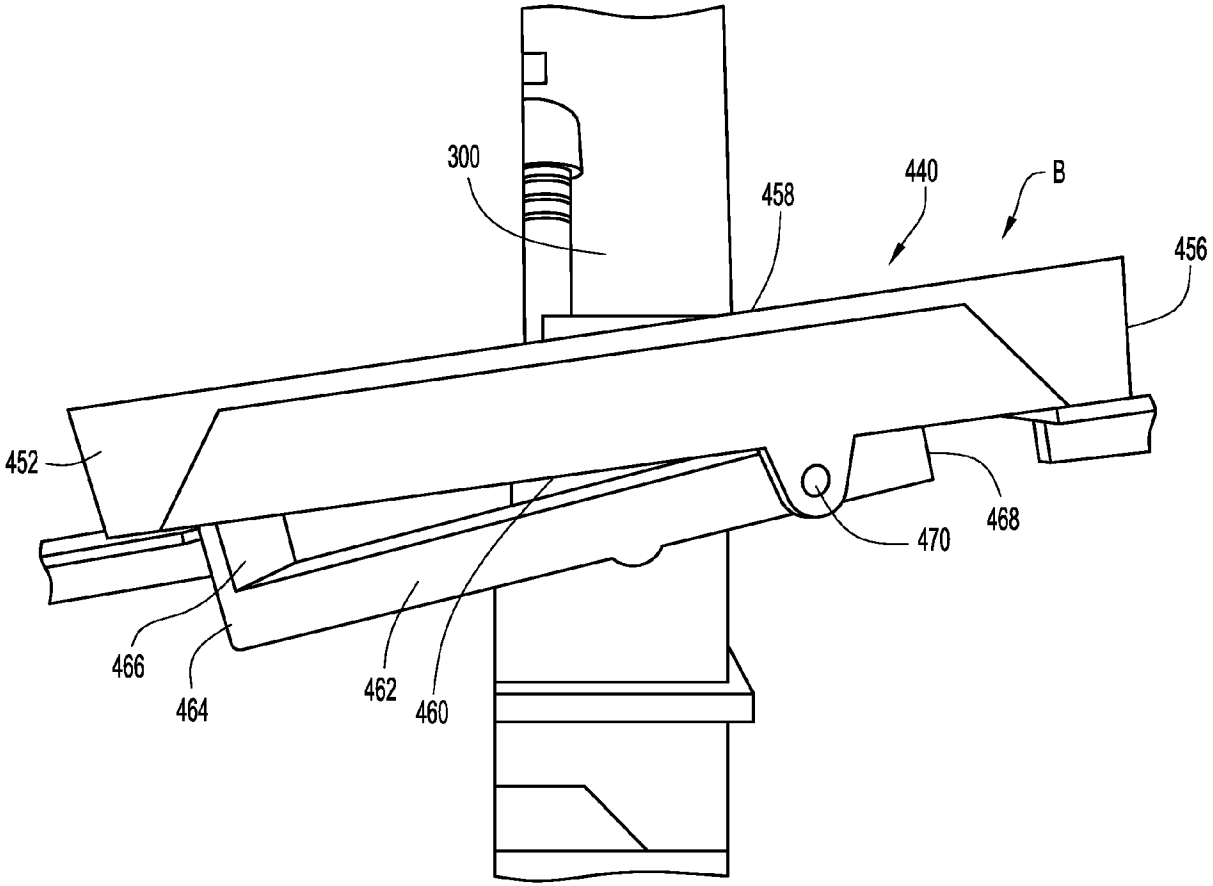
FIG. 4 illustrates a side view of the platform with the retaining mechanism of the embodiment of the toy vehicle play set of FIG. 1, the retaining mechanism being in the releasing configuration.
Figure 5:
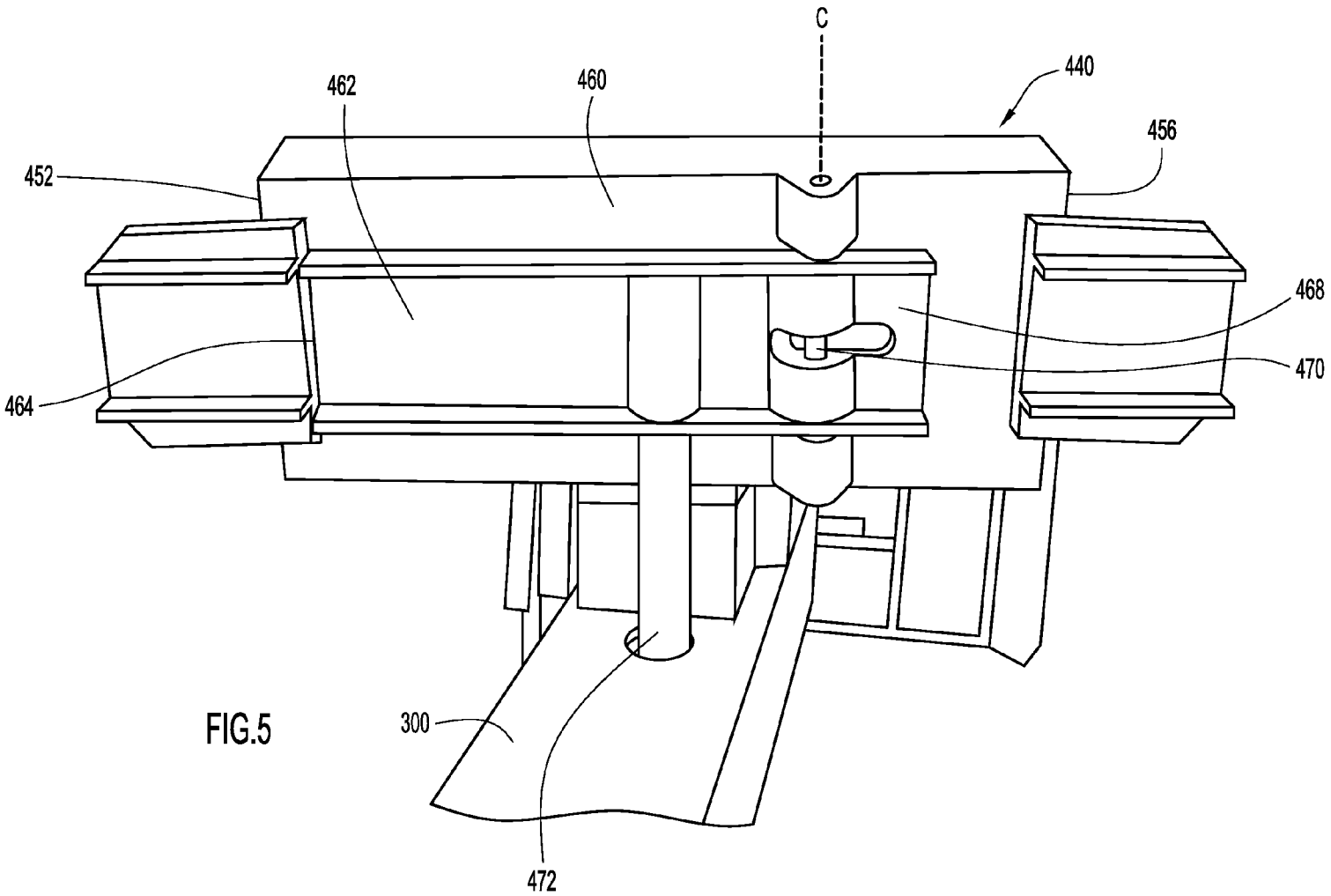
FIG. 5 illustrates a bottom view of the platform with the retaining mechanism of the embodiment of the toy vehicle play set of FIG. 1.

FIGS. 3, 4, and 5 illustrate a first embodiment of a platform 440 with a pivotable member 462. Although the discussion of FIGS. 3-8 focuses on one platform 440 having a pivotable member 462, this concept applies generally to each of the platforms 400, 410, 420, 430 previously discussed and illustrated in FIGS. 1 and 2. Therefore, the structure and components described regarding platform 440 can be similar or identical to those found on the platforms 400, 410, 420, 430 of FIGS. 1 and 2. The platform 440 includes a front end 452, a rear end 456, a top 458, and a bottom 460. As illustrated in FIGS. 3 and 4, the platform 440 is angled for the rear end 456 to be higher in height than the front end 452. The platform 440 is angled to enable a toy vehicle 800 to roll off of the platform 440 via the force of gravity. Attached to the bottom 460 of the platform 440 is a pivotable member 462 with a distal end 464 and a proximal end 468. Specifically, an axle 470 pivotally couples the pivotable member 462 to the bottom 460 of the platform 440 at a location proximate to the proximal end 468 of the pivotable member 462. As best illustrated in FIG. 5, the axle 470 is slid through part of the bottom 460 of the platform 440, such as a pair of shoulders formed with the platform, and through an opening formed in the pivotable member 462. This enables the pivotable member 462 to pivot about axis C, as illustrated in FIG. 5.

The pivotable member 462 includes a retaining tab 466 extending substantially perpendicularly from the distal end 464 of the pivotable member 462. In one embodiment, the pivotable member 462 pivots with respect to the platform 440 such that the retaining tab 466 slides in and out of a slot formed in the bottom 460 of the platform 440. When the retaining tab 466 is inside the slot and in a retaining position, the retaining tab 466 retains a toy vehicle 800 on the platform 440 against the force of gravity. In another embodiment, the retaining tab 466 may be configured to slide past the front end 452 of the platform 440 into a retaining position.

FIG. 3 illustrates the pivotable member 462 in a retaining position A, where a toy vehicle 800 positioned on the platform 440 would be prevented from rolling. FIG. 4 illustrates the pivotable member 462 after it has been pivoted counterclockwise about axis C to its releasing position B. In the releasing position B, the toy vehicle 800 is free to roll off of the platform 440 towards the left side of the illustration. When the pivotable member 462 is in the retaining position A, the retaining tab 466 extends upwardly beyond the bottom 460 of the platform 440 to obstruct the path of the toy vehicle 800, thus preventing the toy vehicle 800 from rolling off the platform 440. When the pivotable member 462 is in the releasing position B, the retaining tab 466 remains below, or level with, the platform 440, thereby allowing the toy vehicle 800 to freely roll off the platform 440 under the force of gravity or otherwise.

FIG. 5 illustrates the bottom 460 of the platform 440. The pivotable member 462 is pivotally coupled to the bottom 460 of the platform 440. An engagement bar 472 extends horizontally from the pivotable member 462 into an opening or aperture 370 (see FIG. 6) formed in the pillar 300. The pivotable member 462 couples to the engagement bar 472 between the distal end 464 and the axle 470, proximate to the axle 470 and the pivoting axis C. As illustrated in FIG. 5, the engagement bar 472 is coupled to the pivotable member 462 closer to the proximal end 468 than to the distal end 464.

Figure 6:
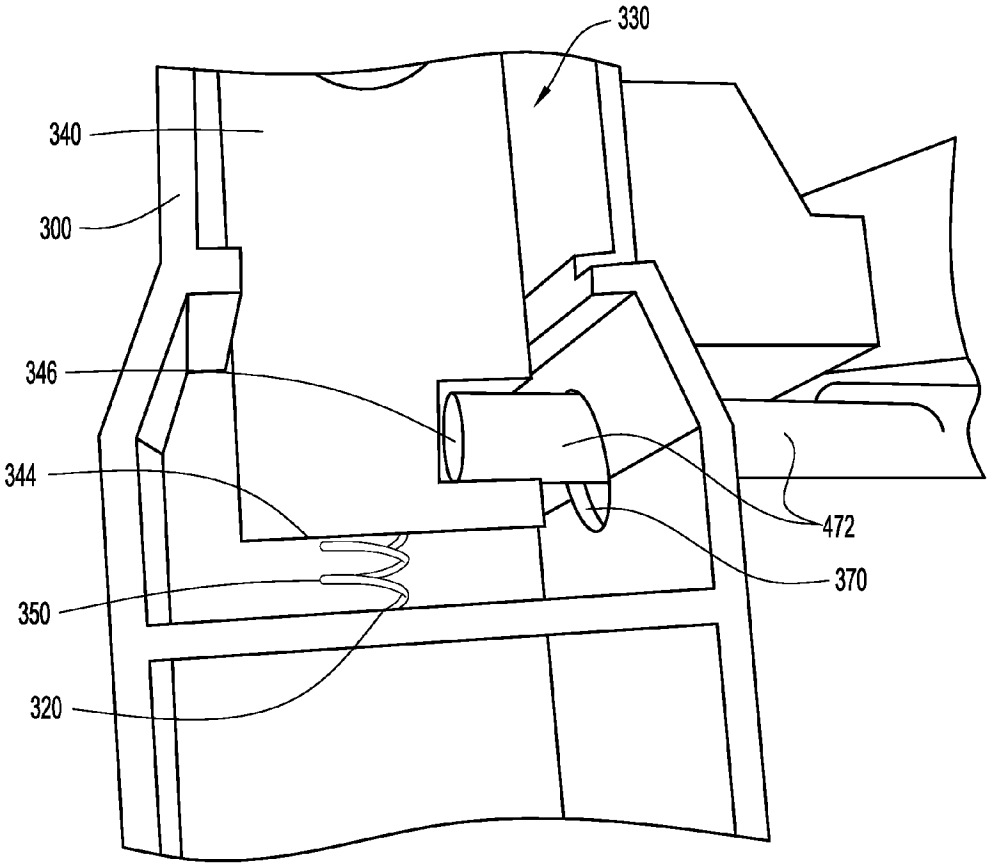
FIG. 6 illustrates an interior view of the bottom of the pillar with the actuation member being disposed within the interior of the pillar of the embodiment of the toy vehicle play set of FIG. 1.

FIG. 6 illustrates a close-up view of the bottom 320 of the pillar 300 and a bottom 344 of the actuation plate 340. As illustrated, the actuation plate 340 slides within the internal cavity 330 of the pillar 300. The actuation plate 340 includes at least one notch 346 that receives the engagement bar 472 of the platform 440. The engagement bar 472 extends through an elongated aperture 370 in the side of the pillar 300. The actuation plate 340 includes one notch 346 for each engagement bar 472 of each platform. Furthermore, the pillar 300 includes an elongated aperture 370 for each platform. Therefore, in the embodiment illustrated in FIGS. 1 and 2, the actuation plate 340 would include at least four notches 346, one to receive the engagement bar 472 from each of the platforms 400, 410, 420, 430. In addition, the pillar 300 would include at least four elongated apertures 370, one for each engagement bar 472 from each of the platforms 400, 410, 420, 430, to allow each engagement bar 472 to be inserted into each notch 346 in the actuation plate 340.

Figure 7:
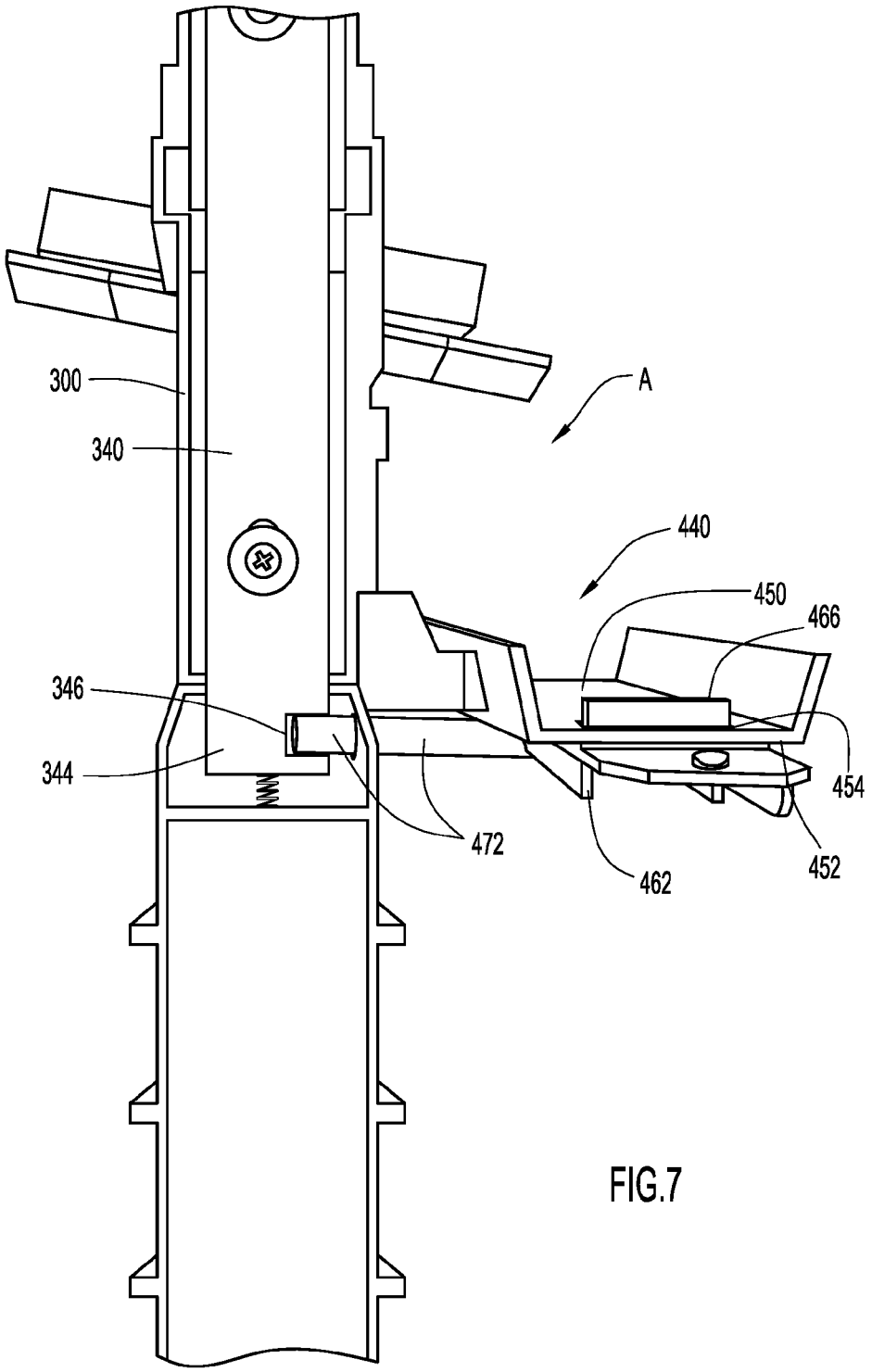
FIG. 7 illustrates a close-up view of the interaction between the platform, the retaining mechanism, the pillar, and the actuation member of the embodiment of the toy vehicle play set of FIG. 1, the retaining mechanism being in the retaining configuration.

Because the notch 346 receives the engagement bar 472 and the engagement bar 472 is coupled to the pivotable member 462, sliding the actuation plate 340 up and down through the interior cavity 330 of the pillar 300 also moves the pivotable member 462 about axis C, which is illustrated in FIG. 5. Moreover, the aperture 370 is sized to allow movement of the engagement bar 472 when the actuation plate 340 moves up and down through the interior cavity 330 of the pillar 300. When the actuation plate 340 is in its upper most position, the pivotable member 462 is in the retaining position A, which is illustrated in FIG. 7. Conversely, when the actuation plate 340 is in its lower most position, the pivotable member 462 is in the releasing position B, which is illustrated in FIG. 8.

FIG. 6 illustrates a resilient member 350 coupled to the bottom 344 of the actuation plate 340 and to the bottom 320 of the pillar 300. The resilient member 350 biases the actuation plate 340 upwardly to its upper most position. As a result, the pivotable member 462 is also biased into its retaining position A. In this embodiment, the resilient member 350 is a coiled spring. In other embodiments, the resilient member 350 may be any such elastic or deformable material that may return the actuation plate 340 to the upper most position. In yet another embodiment, the resilient member 350 may be coupled between the top 310 of the pillar 300 and the top 342 of the actuation plate 340.

Figure 8:
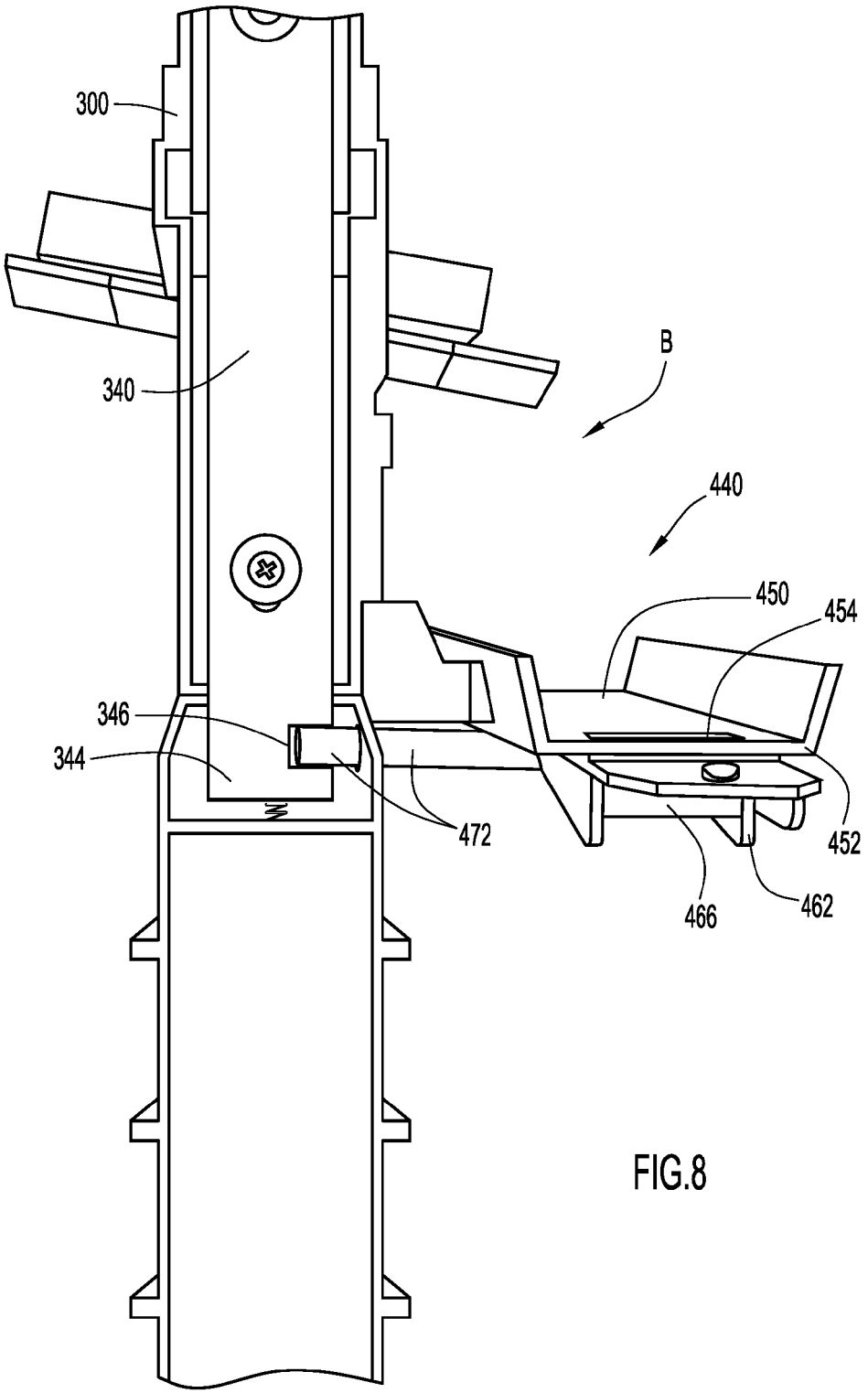
FIG. 8 illustrates a close-up view of the interaction between the platform, the retaining mechanism, the pillar, and the actuation member of the embodiment of the toy vehicle play set of FIG. 1, the retaining mechanism being in the releasing configuration.

FIGS. 7 and 8 illustrate front views of platform 440 with the actuation plate 340 and the pivotable member 462 being positioned in different positions. FIG. 7 illustrates the actuation plate 340 positioned in the upper most position within the pillar 300. As stated previously, the engagement bar 472 engages the notch 346 and is coupled to the pivotable member 462. In the illustrated embodiment, the platform 440 defines a track 450, which is configured to hold a toy vehicle 800, as illustrated in FIG. 1. The platform 440 further includes a slot 454 proximate to the front end 452 of the platform 440. With the actuation plate 340 being biased into the upper most position, the engagement bar 472 biases the pivotable member 462 into the retaining position A, where the retaining tab 466 extends through the slot 454. As stated previously, the retaining tab 466 extending through the slot 454 prevents a toy vehicle 800 from rolling off of the platform 440 by obstructing the path of the toy vehicle 800.

As opposed to FIG. 7, FIG. 8 illustrates the actuation plate 340 in the lower most position and the pivotable member 462 in the releasing configuration B. It can be seen that the bottom 344 of the actuation plate 340 is lower in FIG. 8 than in FIG. 7. As stated previously, when the actuation plate 340 is in the lower most position, the engagement bar 472, which is inserted into notch 346, is pushed downwardly, thus causing the pivotable member 462 to rotate into the releasing position B from the retaining position A. The pivotable member 462 is pivoted downwardly so the retaining tab 466 is not extending through the slot 454. As illustrated, a toy vehicle 800 would then have an unobstructed path along track 450 to roll off of the platform 440, e.g. under the force of gravity. Thus, with the present invention, a single actuation movement (e.g. downward in the illustrated embodiment) of the plunger 360 simultaneously releases all the vehicles from the various different platforms. The downward movement of the plunger 360 slides the actuation plate 340 downward, and each of the engagement bars 472 for the pivotable members 462 moves downward as well, thereby simultaneously pivoting the pivotable members 462 and their retaining tabs 466 out of the way of toy vehicles 800 on the play set.

Figure 9:
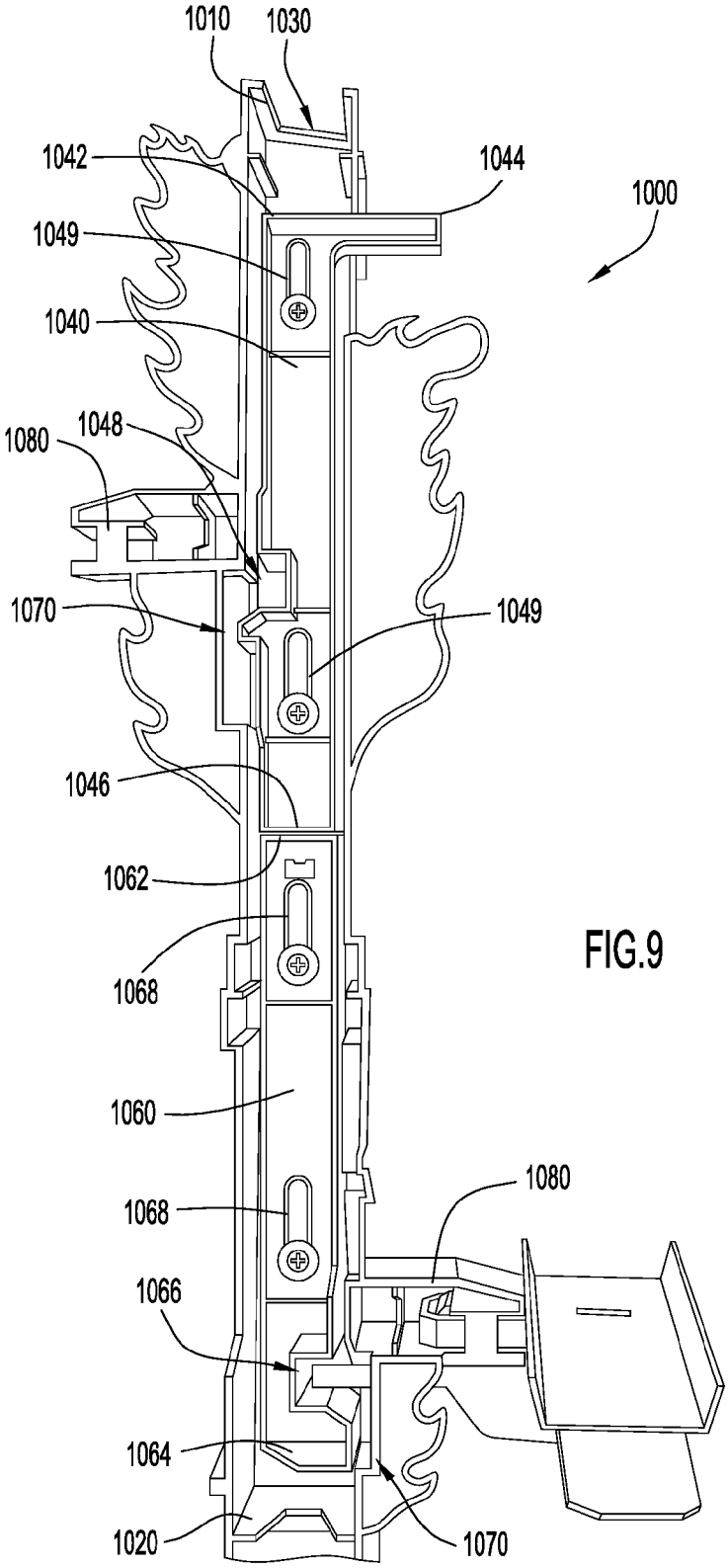
FIG. 9 illustrates a side view of a second embodiment of the pillar of a toy vehicle play set in accordance with the present invention.
Figure 10A:
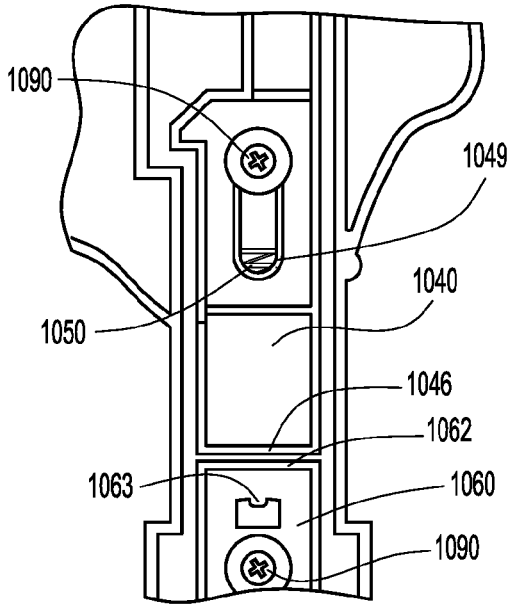
FIG. 10A illustrates a close-up side view of the top actuation plate and bottom actuation plate of the second embodiment of the pillar illustrated in FIG. 9, both the top and bottom actuation plates being oriented in a lowered position.

Illustrated in FIGS. 9, 10A, 10B, and 17 is a second embodiment of the pillar or support 1000 in accordance with the present invention. As best illustrated in FIG. 9, the pillar or support 1000 includes a top 1010 and a bottom 1020. Not illustrated, but similar to the first embodiment of the pillar 300, the bottom 1020 of the pillar 1000 is coupled to a base 200. Also similar to the previous embodiment of the pillar 300, the pillar 1000 has three sides that define an interior cavity or slot 1030. Within the interior cavity 1030 is a top actuation plate 1040 and a bottom actuation plate 1060. The top and bottom actuation plates 1040, 1060 are capable of sliding vertically within the cavity 1030 of the pillar 1000. The top actuation plate 1040 includes a top 1042 and a bottom 1046. The bottom actuation plate 1060 also includes a top 1062 and a bottom 1064. Furthermore, the top 1042 of the top actuation plate 1040 is located proximate to the top 1010 of the pillar 1000 and the bottom 1064 of the bottom actuation plate 1060 being located proximate to the bottom 1020 of the pillar 1000. As illustrated in FIGS. 9 and 10A, the bottom 1046 of the top actuation plate 1040 abuts the top 1062 of the bottom actuation plate 1060. The top 1042 of the top actuation plate 1040 includes an extension arm 1044 that extends laterally from the top actuation plate 1040 beyond the pillar 1000.

Figure 10B:
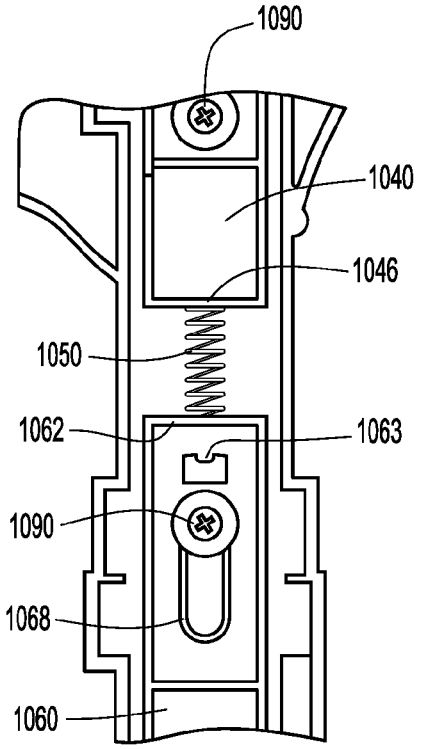
FIG. 10B illustrates a close-up side view of the top and bottom actuation plates of the second embodiment of the pillar illustrated in FIG. 9, the top actuation plate being oriented in an upper position that is different from the lowered position illustrated in FIG. 10A.

As best illustrated in FIG. 9, the top actuation plate 1040 includes two slots 1049 through which screws 1090 are inserted. Furthermore, the bottom actuation plate 1060 includes two slots 1068 through which fasteners or screws 1090 are inserted (see FIGS. 10A and 10B). The screws 1090 are coupled to the pillar 1000, and enable the top actuation plate 1040 and bottom actuation plate 1060 to slide within the internal cavity 1030 a distance equal to the length of the slots 1049, 1068. Furthermore, as illustrated in FIGS. 10A, 10B, the bottom actuation plate 1060 includes an engagement hook 1063 disposed proximate to the top 1062 of the bottom actuation plate 1060. Coupled to the engagement hook 1063 is a resilient member 1050 that is coupled to the pillar 1000 at a location behind the top actuation plate 1040.

When the top actuation plate 1040 is moved downward in the internal cavity 1030 of the pillar 1000 to a lowered position, the bottom 1046 of the top actuation plate 1040, which contacts the top 1062 of the bottom actuation plate 1060, forces the bottom actuation plate 1060 to also move downward in the internal cavity 1030 of the pillar 1000 to a lowered position. As the bottom actuation plate 1060 is moved downward, the resilient member 1050, which in this embodiment is a spring, is elongated, storing potential energy within the resilient member 1050. The top and bottom actuation plates 1040, 1060 are moved downward until the screws 1090 are oriented in the top of the slots 1049, 1068, as illustrated in FIG. 10A. When the force pushing the top and bottom actuation plates 1040, 1060 downward is removed, the potential energy stored in the resilient member 1050 is converted to kinetic energy, causing the bottom actuation plate 1060 to be returned to the previous, upper position, where the screws 1090 are oriented in the bottom portion of the slots 1063, as illustrated in FIG. 9. Moreover, as the bottom actuation plate 1060 is returned to the upper position, the top 1062 of the bottom actuation plate 1060 forces the top actuation plate 1040 to move upward to the upper position, where the screws 1090 are oriented in the bottom portion of the slots 1049, as illustrated in FIG. 9. FIG. 10B illustrates the bottom actuation plate 1060 is moved to the lowered position while the top actuation plate 1040 remains in the upper position, which is shown for illustrative purposes only. In normal operation of the toy vehicle play set 100, the bottom actuation plate 1060 does not move from the upper position to the lowered position unless the top actuation plate 1040 is also moved from the upper position to the lowered position, forcing the bottom actuation plate 1060 to move to the lowered position.

As further illustrated by FIG. 9, the pillar or support 1000 includes a plurality of receptacles 1080 located along the outer surface of the pillar 1000. While FIG. 9 illustrates two receptacles 1080, other receptacles may be located about the pillar 1000. Beneath each of the receptacles 1080 are apertures 1070 disposed in the sidewalls of the pillar 1000. Furthermore, the top actuation plate 1040 includes at least one notch 1048, which, in the illustrated embodiment, is located above the lower slot 1049. The bottom actuation plate 1060 includes two notches 1066, one located below the lower slot 1068, and one not shown because it is on the backside of the bottom actuation plate 1060. Each of the notches 1048, 1066 are located proximate to the apertures 1070 on the pillar 1000, which are located below the receptacles 1080. The notches 1048, 1066 receive the engagement bar 634 of the pivotable member 622 of the platform 600, which is illustrated in FIGS. 11, 12A, 12B, 13, and 15.

Figure 17:
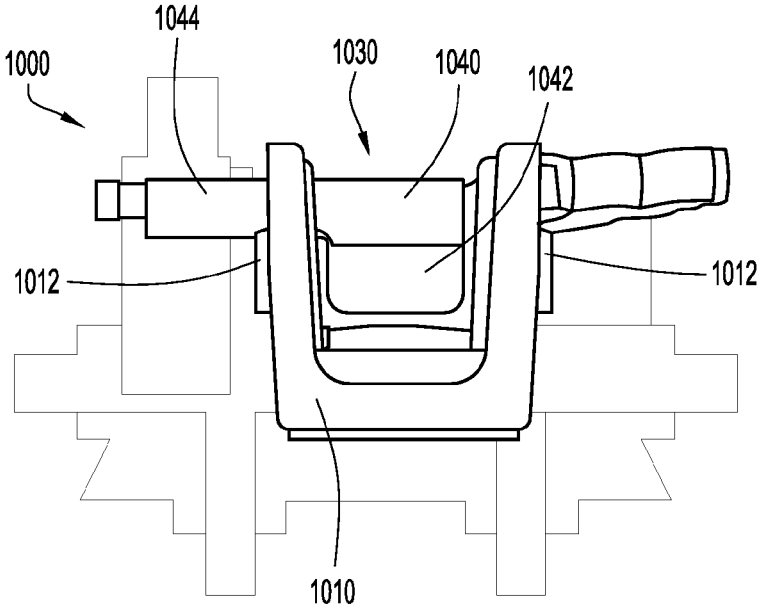
FIG. 17 illustrates a top view of the second embodiment of the pillar illustrated in FIG. 9.

FIG. 17 illustrates a top view of the pillar 1000, which views down the internal cavity 1030 of the pillar. Furthermore, as previously explained, the top actuation plate 1040 is disposed within the internal cavity 1030 of the pillar 1000. FIG. 17 illustrates that the extension arm 1044 protrudes out of the side of the pillar 1000 from the top 1042 of the top actuation plate 1040. Moreover, extending outwardly from the top 1010 of the pillar 1000 are two protrusions 1012 on opposite sides from one another.

Figure 11:
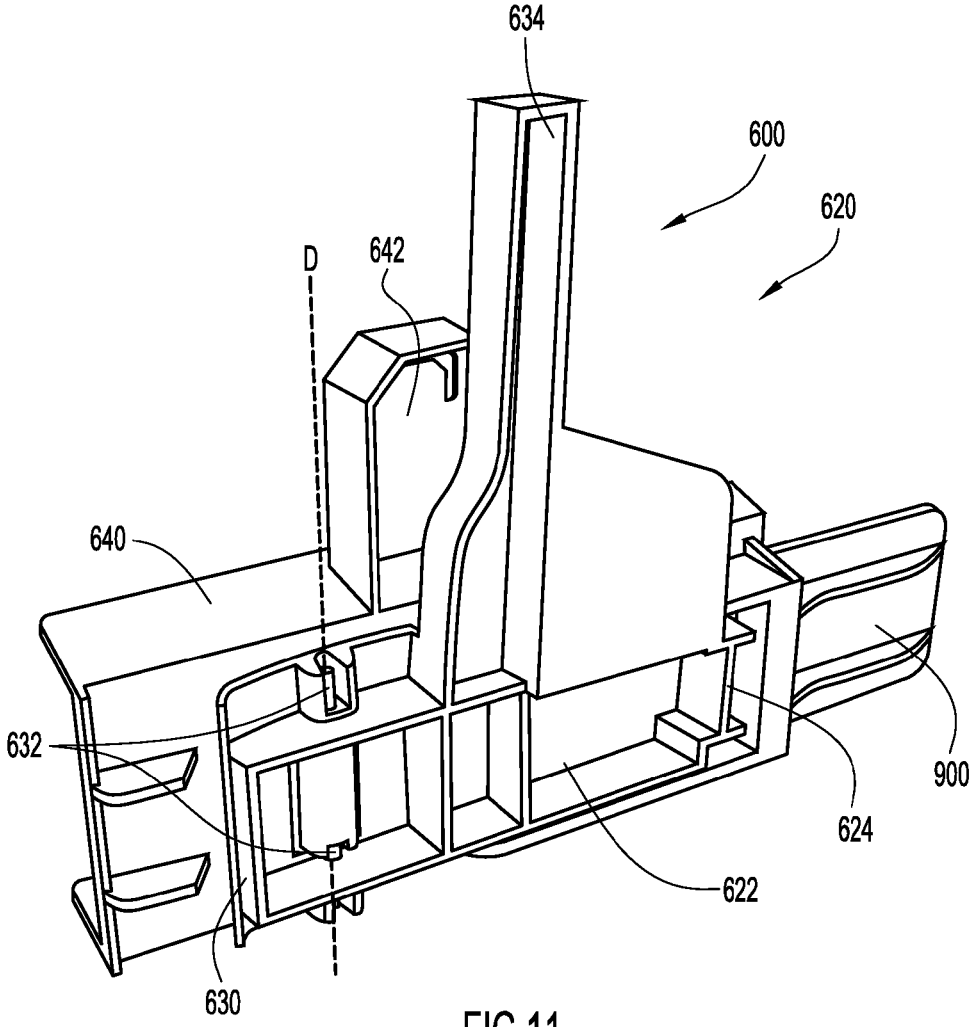
FIG. 11 illustrates a bottom view of a second embodiment of a platform with the retaining mechanism of a toy vehicle play set in accordance with the present invention.

FIGS. 11, 12A, 12B, and 13 illustrate a second embodiment of the platforms 600. Although the discussion of FIGS. 11, 12A, 12B, and 13 only includes one platform 600 having a pivotable member 622, this concept applies to each of the platforms that are attached to the receptacles 1080 of the pillar 1000. Similar to the first embodiment of the platform 440, the second embodiment of the platform 600 includes a front end 612, a rear end 616, a top 618, and a bottom 620. As illustrated in FIG. 11, pivotally attached to the bottom 620 of the platform 600 is pivotable member 622 with a distal end 624 and a proximal end 630. Specifically, an axle 632 is inserted through the proximal end 630 of the pivotable member 622 and the rear end 616 of the platform 600. The axle 632 pivotally couples the pivotable member 622 at a location proximate to the proximal end 630 of the pivotable member 622 to the rear end 616 of the bottom 620 of the platform 600. As best illustrated in FIG. 11, the proximal end 630 of the pivotable member 622 is disposed around a cylinder formed in the bottom 620 of the platform 600, so that cylinder is positioned within a portion of the proximal end 630 of the pivotable member 622. The axle 632 is slid through one side of the proximal end 630 of the pivotable member 622, and through a channel within the cylinder formed on the bottom 620 of the platform 600. The axle 632 enables the pivotable member 622 to pivot about axis D, as illustrated in FIG. 11.

As further illustrated in FIG. 11, an engagement bar 634 extends horizontally from the pivotable member 622. The engagement bar 634 is coupled to the pivotable member 622 between the distal end 624 and the axle 632. Furthermore, the engagement bar 634 extends horizontally from the pivotable member 622 proximate to the axle 632 and the pivoting axis D. Moreover, extending horizontally from the side 640 of the platform 600, in the same direction as the engagement bar 634, is an extension arm 642.

Figure 12A:
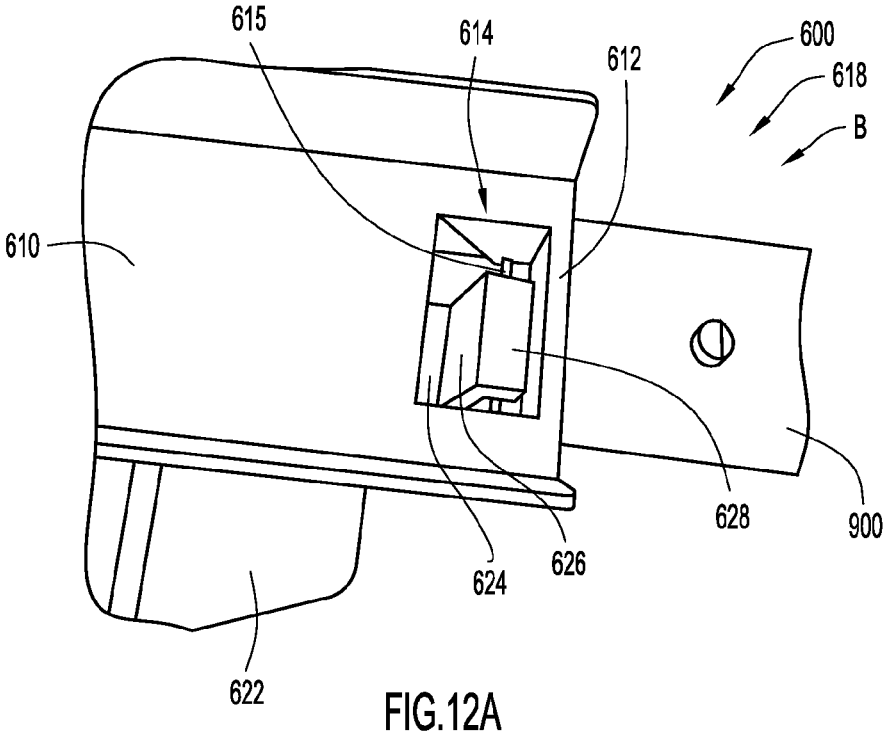
FIG. 12A illustrates a top view of the second embodiment of the platform illustrated in FIG. 11, the retaining mechanism being in the releasing configuration.
Figure 12B:
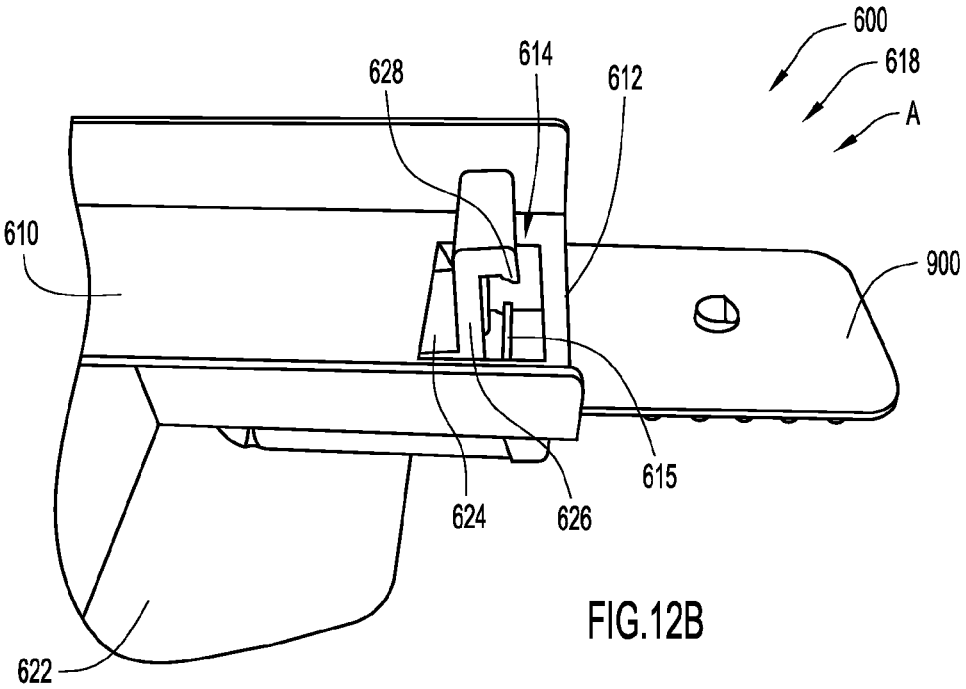
FIG. 12B illustrates a side view of the second embodiment of the platform illustrated in FIG. 11, the retaining mechanism being in the retaining configuration.

As illustrated in FIGS. 12A and 12B, the top 618 of the platform 600 forms a track 610 configured to hold a toy vehicle 800, similar to that illustrated in FIG. 1. Similar to the first embodiment of the platform 440, the platform 600 is angled so that the rear end 616 is higher in height than the front end 612. The platform 600 is angled to enable a toy vehicle 800 to roll off of the platform 600 via the force of gravity. As further illustrated in FIGS. 12A and 12B, the front end 612 of the platform 600 includes a slot 614 disposed within the track 610 and a connection tongue 900 extending from the front end 612. In this second embodiment, within the slot 614 is a small ledge 615. Furthermore, the pivotable member 622 includes a retaining tab 626 extending substantially perpendicularly from the distal end 624 of the pivotable member 622. The retaining tab 626 is configured to slide upward through the slot 614 formed in the front end 612 of the platform 600 to prevent a toy vehicle 800 from rolling down the platform 600. The retaining tab 626 includes a hook 628.

FIG. 12B illustrates the pivotable member 622 in the retaining position A, where the toy vehicle 800 would remain on the platform 600. FIG. 12A illustrates the pivotable member 622 pivoted to its releasing position B, where the toy vehicle 800 is able to roll off of the platform 600. When the pivotable member 622 is in the retaining position A, the retaining tab 626 and hook 628 extend upwardly through the slot 614 of the platform 600 to obstruct the path of the toy vehicle 800, preventing the toy vehicle 800 from rolling off the platform 600. When the pivotable member 622 is in the releasing position B, the retaining tab 626 and hook 628 do not extend through the slot 614, and the hook 628 is positioned to rest upon the ledge 615 within the slot 614. When in the releasing position B, the toy vehicle 800 is free roll off the platform 600 under the force of gravity or otherwise. The hook 628 resting on the ledge 615 within the slot 614 prevents the retaining tab 626 and the hook 628 from becoming misaligned with the slot 614 during movement from the retaining position A to the releasing position B, and vice versa. The hook 628 and the ledge 615 also prevent the pivotable member 622 from pivoting too far when pivoted from the retaining position A to the releasing position B.

Figure 13:
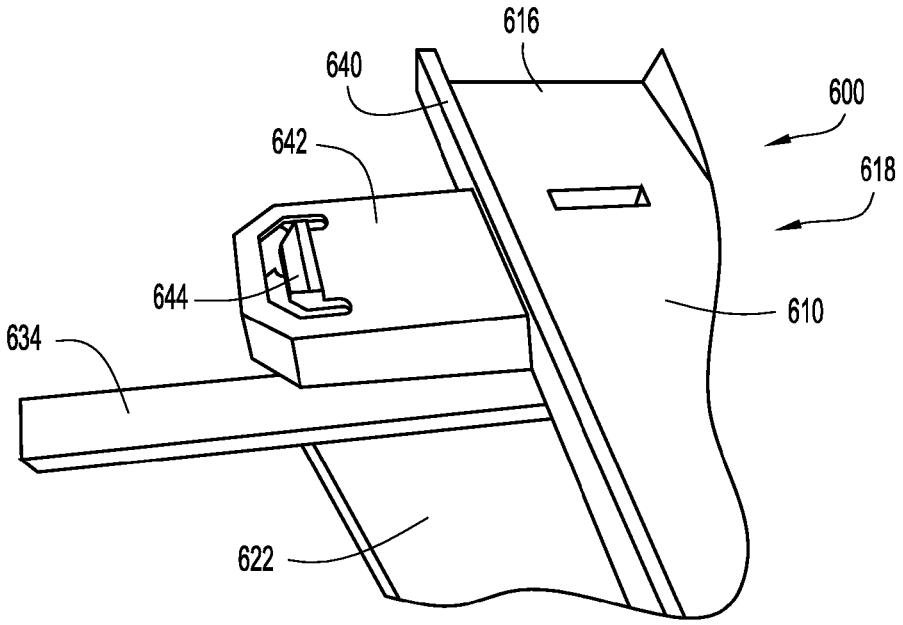
FIG. 13 illustrates a perspective view of the connecting tab of the second embodiment of the platform illustrated in FIG. 11.

FIGS. 11 and 13 illustrate the platform 600 including an extension arm 642 extending horizontally from the side 640 of the platform 600. The extension arm 642 extends from the side 640 of the platform 600 in the same direction as the engagement bar 634. Moreover, disposed on the end of the extension arm 642 is an engagement tab 644.

Figure 14:
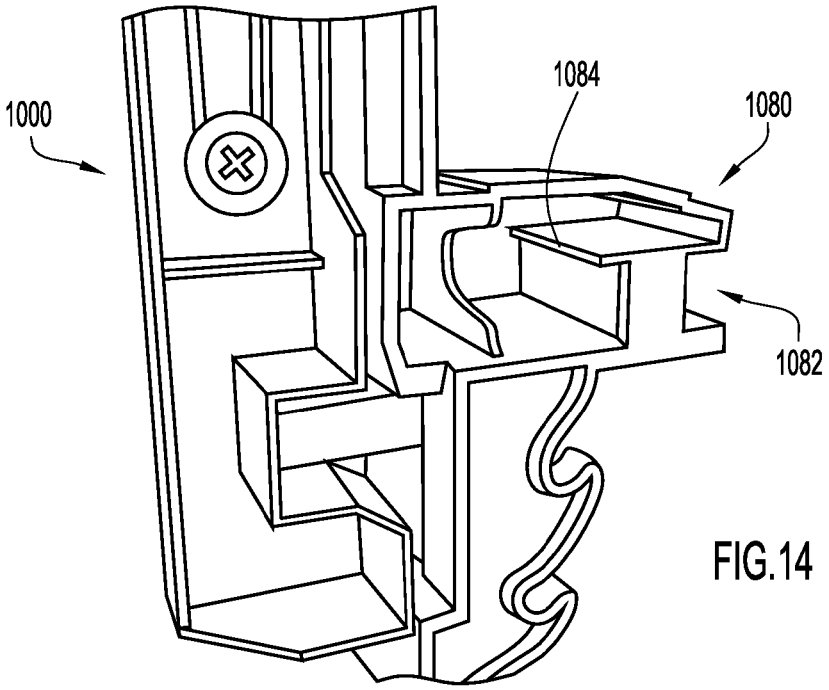
FIG. 14 illustrates a side view of a receptacle disposed on the side of the second embodiment of the pillar illustrated in FIG. 9.

FIG. 14 illustrates a receptacle 1080 that is disposed on the pillar 1000. As illustrated, the receptacle 1080 includes an opening 1082 and an upper ledge 1084. While FIG. 14 illustrates only one receptacle 1080, the description of the receptacle 1080 of FIG. 14 applies each of the receptacles 1080 disposed on the pillar 1000.

Figure 15:
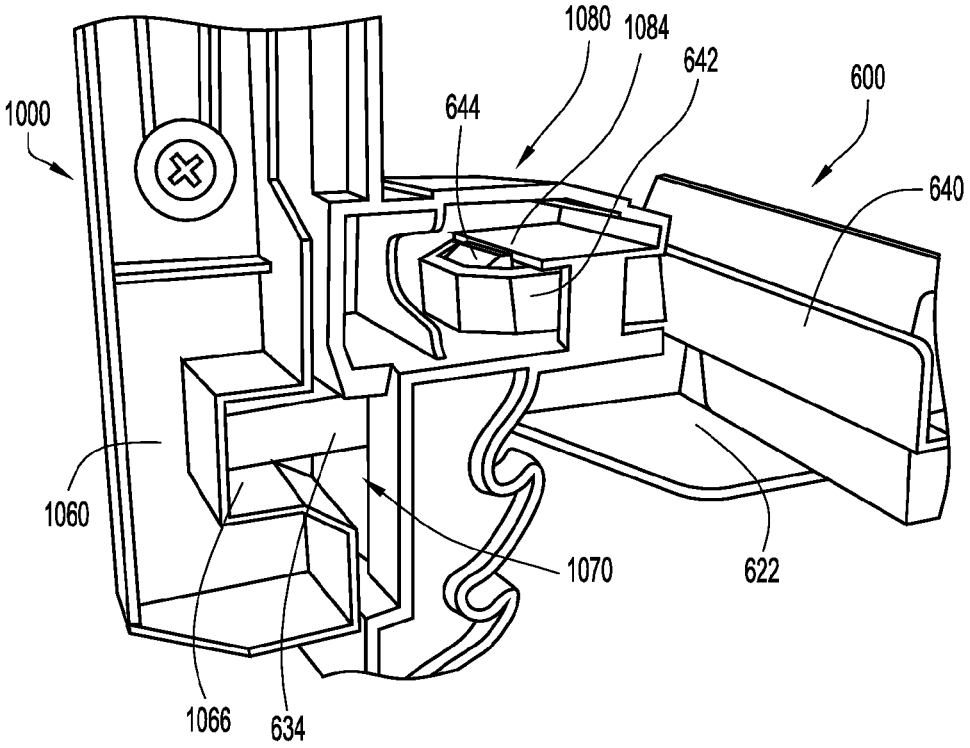
FIG. 15 illustrates a side view of the second embodiment of the platform illustrated in FIG. 11 coupled to the second embodiment of the pillar illustrated in FIG. 9, the connecting tab illustrated in FIG. 13 being inserted into the receptacle illustrated in FIG. 14.

FIG. 15 illustrates the platform 600 attached to the pillar 1000. The extension arm 642 is inserted into the opening 1082 of the receptacle 1080. Moreover, the engagement tab 644 on the end of the extension arm 642 is engaged with the end of the upper ledge 1084 to lock the platform 600 into engagement with the receptacle 1080 and the pillar 1000. Furthermore, the engagement bar 634, which is extends from the pivotable member 622 in the same direction as the extension arm 642 extends from the side 640 of the platform 600, is positioned beneath the receptacle 1080. The engagement bar 634, which is longer than the extension arm 642, extends through the aperture 1070 of the pillar, which is beneath the receptacle 1080, and into the notch 1066 of the bottom actuation plate 1060. As briefly explained previously, the notches 1048, 1066 are configured to receive the engagement bars 634 of the pivotable member 622 of the platform 600. While only the bottom actuation plate 1060 is illustrated in FIG. 15, when a platform 600 is coupled to the receptacle 1080 that is located proximate the top actuation plate 1040, the notch 1048 on the top actuation plate 1040 will also receive the engagement bar 634 from that platform 600.

Because the notches 1048, 1066 receive the engagement bars 634 and the engagement bars 634 are coupled to the pivotable members 622 of the platform 600, movement of the top and bottom actuation plates 1040, 1060 by sliding up and down through the interior cavity 1030 of the pillar 1000 pivots the pivotable members 622 about axis D, which is illustrated in FIG. 11. Moreover, the apertures 1070 may be elongated to allow movement of the engagement bars 634 when the top and bottom actuation plates 1040, 1060 are slid up and down through the interior cavity 1030 of the pillar 1000. When the top and bottom actuation plates 1040, 1060 are in the upper position described previously, the pivotable members 622 of the side platforms 600 are configured in the retaining position A, which is illustrated in FIG. 12B. Conversely, when the top and bottom actuation plates 1040, 1060 are in the lowered position described previously, the pivotable members 622 are configured in the releasing position B, which is illustrated in FIG. 12A.

Figure 16A:
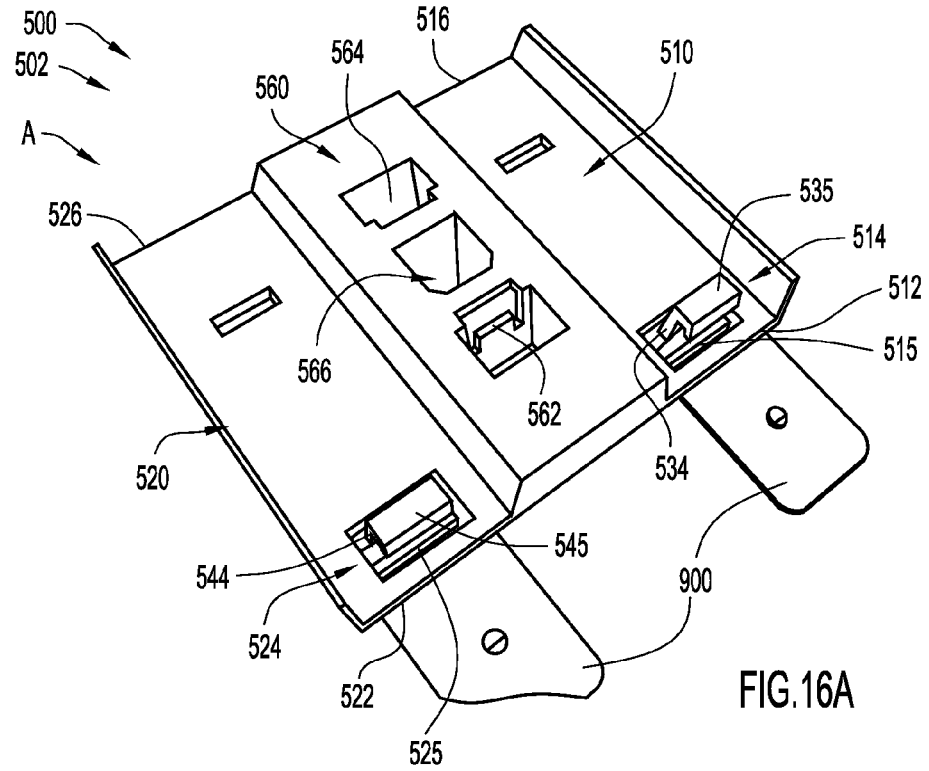
FIG. 16A illustrates a top view of the second embodiment of the first or top platform of a toy vehicle play set.
Figure 16B:
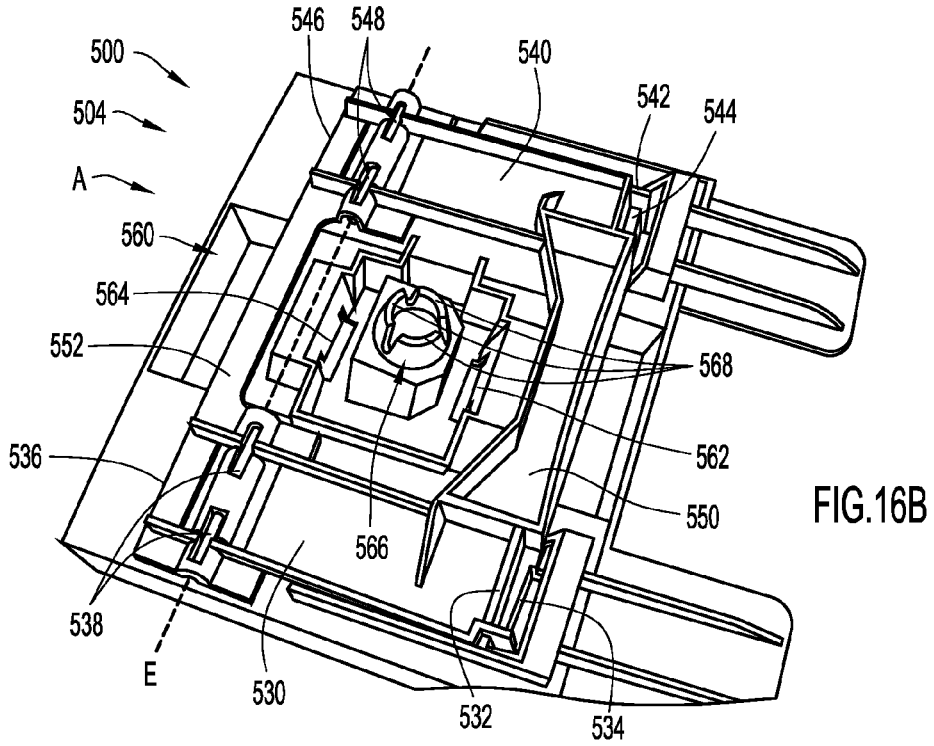
FIG. 16B illustrates a bottom view of the second embodiment of the top platform illustrated in FIG. 16A.

Turning to FIGS. 16A and 16B, illustrated is the top platform 500. FIG. 16A illustrates the top 502 of the top platform 500, while FIG. 16B illustrates the bottom 504 of the top platform 500. As illustrated in FIGS. 16A and 16B, the top platform 500 includes a first track 510, a second track 520, and a central portion 560 positioned between, and separating, the first track 510 and the second track 520. Similar to the side platforms 600, the first track 510 includes a front end 512 and a rear end 516, and the second track 520 includes a front end 522 and a rear end 526. The rear ends 516, 526 of the first and second tracks 510, 520 are higher in height than the front ends 512, 522. Thus, the first and second track 510, 520 are downwardly sloped from the rear ends 516, 526 toward the front ends 512, 522 so that a toy vehicle 800 positioned on either of the first or second tracks 510, 520 will roll off of the top platform 500 via the force of gravity.

As illustrated in FIG. 16B, pivotally attached to the bottom 504 of the top platform 500 is a first pivotable member 530, with a distal end 532 and a proximal end 536, and a second pivotable member 540, with a distal end 542 and a proximal end 546. The first pivotable member 530 is positioned beneath the first track 510, while the second pivotable member 540 is positioned beneath the second track 520. Similar to the side platform 600, a first axle 538 and a second axle 548 couple the first and second pivotable members 530, 540 to the first and second tracks 510, 520, respectively. The first axle 538 is inserted through the proximal end 536 of the first pivotable member 530 and the rear end 516 of the first track 510. The second axle 548 is inserted through the proximal end 546 of the second pivotable member 540 and the rear end 526 of the second track 520. As illustrated in FIG. 16B, and similar to the side platform 600, cylinder-like protrusions are formed on the bottom 504 of the first and second tracks 510, 520. The proximal end 536 of the first pivotable member 530 is disposed around the cylinder-like protrusion formed in the bottom 504 of the first track 510, and the proximal end 546 of the second pivotable member 540 is disposed around the cylinder-like protrusion formed in the bottom 504 of the second track 520. The cylinder-like protrusions are positioned within a portion of the proximal ends 536, 546 of the first and second pivotable members 530, 540. The first axle 538 is inserted through the proximal end 536 of the first pivotable member 530 and the cylinder-like protrusion on the bottom 504 of the first track 510. The second axle 548 is inserted through the proximal end 546 of the second pivotable member 540 and the cylinder-like protrusion on the bottom 504 of the second track 520. Thus, the first and second axles 538, 548 enable the first and second pivotable members 530, 540 to pivot about axis E.

Moreover, further illustrated in FIG. 16B is a front connector bar 550 and a rear connector bar 552. The front connector bar 550 is coupled to the distal end 532 of the first pivotable member 530 and the distal end 542 of the second pivotable member 540. The rear connector bar 552 is coupled to the proximal end 536 of the first pivotable member 530 and the proximal end 546 of the second pivotable member 540. The front and rear connector bars 550, 552 ensure that the first and second pivotable members 530, 540 simultaneously pivot about axis E. Unlike the side platform 600, the top platform 500 does not include an engagement bar extending from the first and second pivotable members 530, 540.

Turning back to FIG. 16A, a first slot 514 is disposed proximate the front end 512 of the first track 510, and a second slot 524 is disposed proximate the front end 522 of the second track 520. Similar to that described for the side platform 600, within the first and second slots 514, 524 are small ledges 515, 525. Furthermore, the first pivotable member 530 includes a first retaining tab 534 extending substantially perpendicularly from the distal end 532 of the first pivotable member 530. Similarly, the second pivotable member 540 includes a second retaining tab 544 extending substantially perpendicularly from the distal end 542 of the second pivotable member 540. The retaining tabs 534, 544 are configured to slide through the slots 514, 524 from the bottom 504 of the platform 500. The first retaining tab 534 includes a hook 535, and the second retaining tab 544 also includes a hook 545.

Similar to that explained for the side platform 600, the first and second pivotable members 530, 540 are configured to pivot between a retaining position A and a releasing position B. When the first and second pivotable members 530, 540 are in the retaining position A, which is illustrated in FIGS. 16A and 16B, the first and second retaining tabs 534, 544 and hooks 535, 545 extend upwardly through the first and second slots 514, 524, respectively, to obstruct the path of a toy vehicle 800 placed in the first and second tracks 510, 520, preventing the toy vehicle 800 from rolling off the top platform 500. When the first and second pivotable members 530, 540 are pivoted to the releasing position B (not illustrated), the first and second retaining tabs 534, 544 and hooks 535, 545 do not extend through the first and second slots 514, 524. Moreover, when in the releasing position B, the hooks 535, 545 are positioned to rest upon the first and second ledges 515, 525 within the first and second slots 514, 524, respectively. When in the releasing position B, a toy vehicle 800 is free to roll down the first or second tracks 510, 520 and off of the top platform 500 under the force of gravity or otherwise. As previously explained, the hooks 535, 545 resting on the ledges 515, 525 within the first and second slots 514, 524 prevent the first and second retaining tabs 534, 544 and the hooks 535, 545 from becoming misaligned with the first and second slots 514, 524 when the first and second pivotable members 530, 540 are pivoted between the retaining position A and the releasing position B, and vice versa. The hooks 535, 545 and the ledges 515, 525 also prevent the first and second pivotable members 530, 540 from pivoting too far when pivoted from the retaining position A to the releasing position B.

As illustrated in FIG. 16A, the central portion 560 is positioned between the first track 510 and the second track 520. The central portion 560 is raised compared to the first and second tracks 510, 520. The central portion 560 includes an opening 566 that extends from the top 502 to the bottom 504 through the entire top platform 500. As illustrated in FIG. 16B, the bottom 502 includes a set of tabs 568 that extend downwardly around the opening 566. Furthermore, the portion of the opening 566 on the top 502 of the top platform 500 is larger than the portion of the opening 566 on the bottom 502 of the top platform 500. The opening 566 may include a specific, non-circular, shape to the opening, as illustrated in FIG. 16A. The central portion 560 further includes a first connection flange 562 and a second connection flange 564. The first and second connection flanges 562, 564 are disposed one on either side of the opening 566. Moreover, connection tongues 900 extend from the front end 512 of the first track 510 and the front end 522 of the second track 520.

Figure 18:
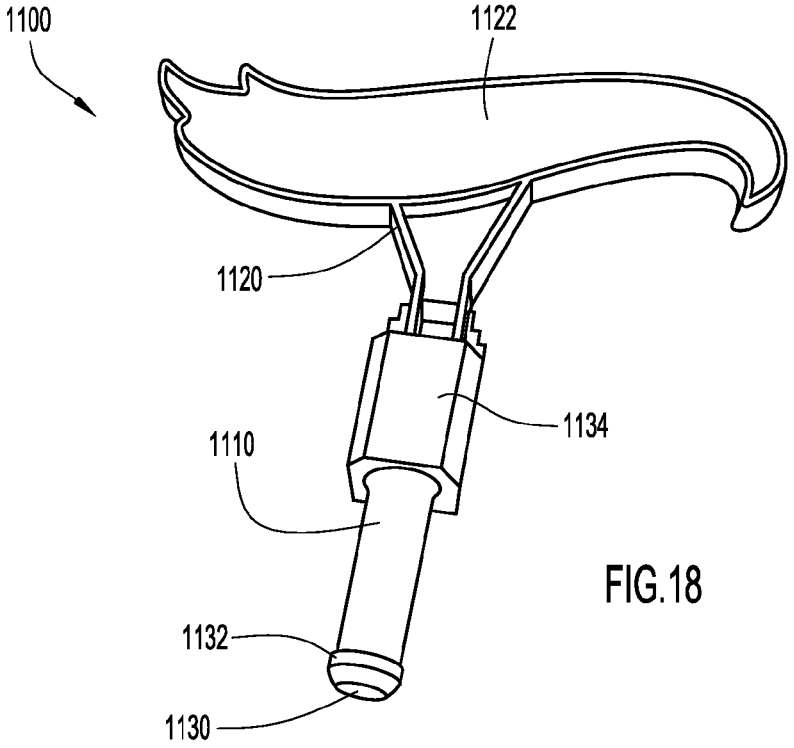
FIG. 18 illustrates a side view of the second embodiment of the plunger decoupled from the top platform illustrated in FIG. 16A.
Figure 19:
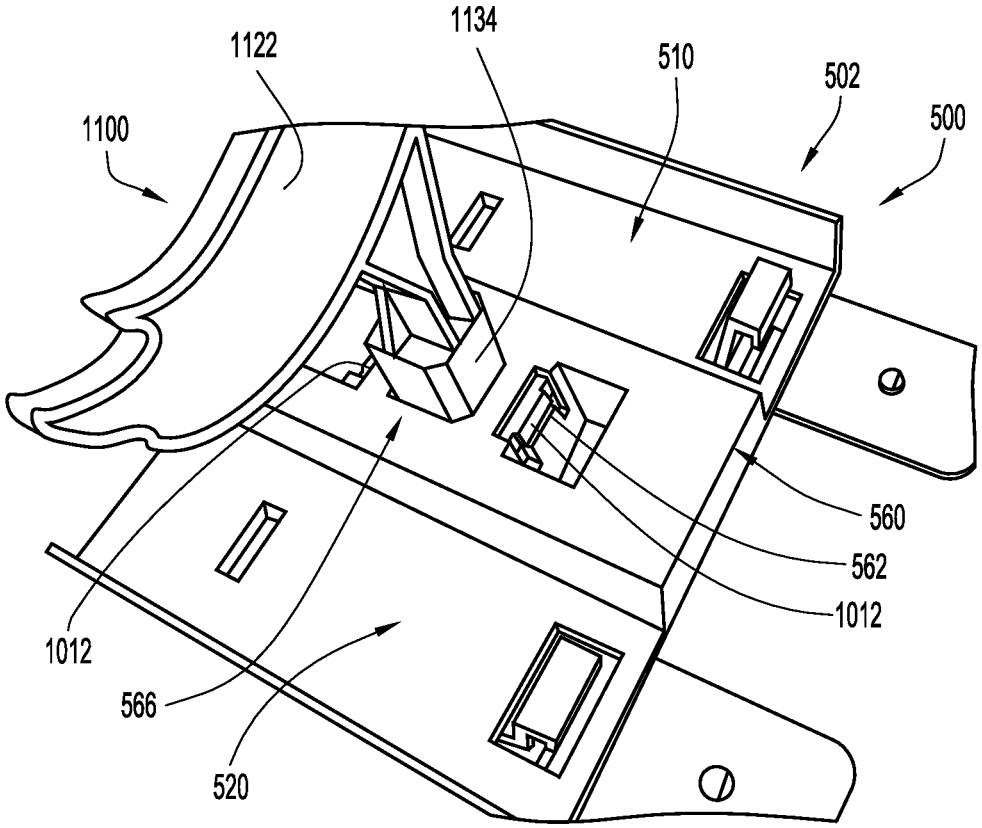
FIG. 19 illustrates a top view of the second embodiment of the top platform illustrated in FIG. 16A attached to the top of the second embodiment of the pillar illustrated in FIG. 9, with the plunger of FIG. 18 coupled to the top platform.
Figure 20A:
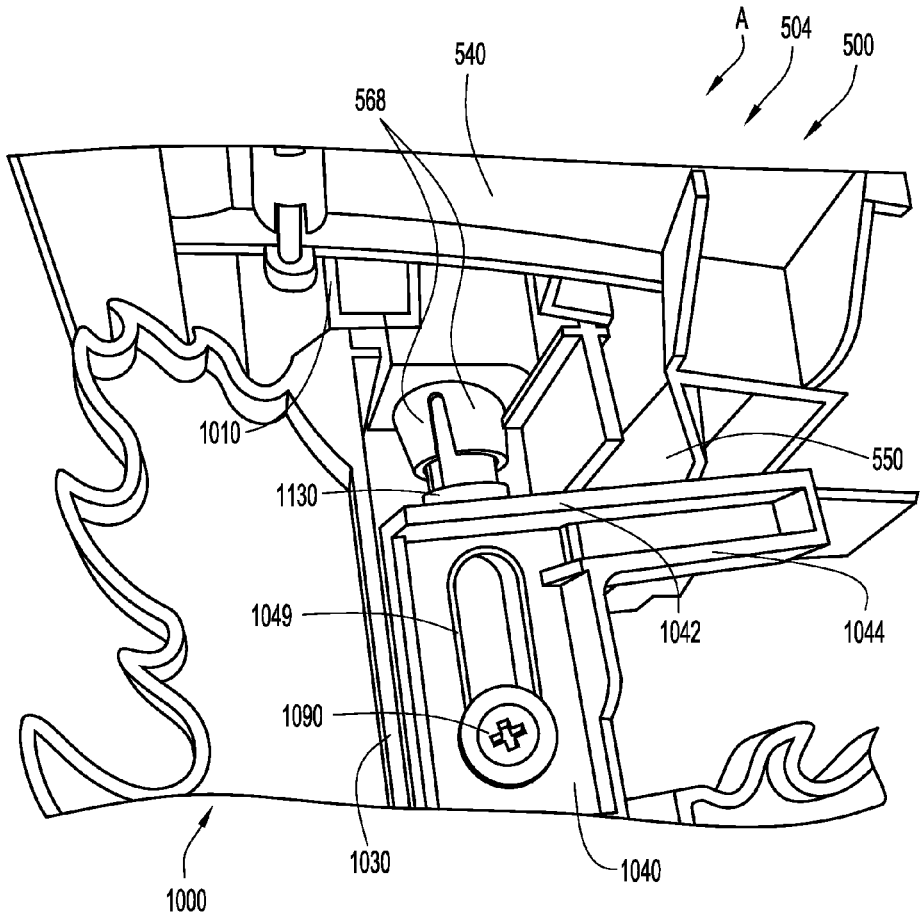
FIG. 20A illustrates a bottom view of the second embodiment of the top platform illustrated in FIG. 16A coupled to the top of the second embodiment of the pillar illustrated in FIG. 9, the bottom of the plunger illustrated in FIG. 18 being engaged with the top actuation plate of the pillar in a retaining configuration.
Figure 20B:
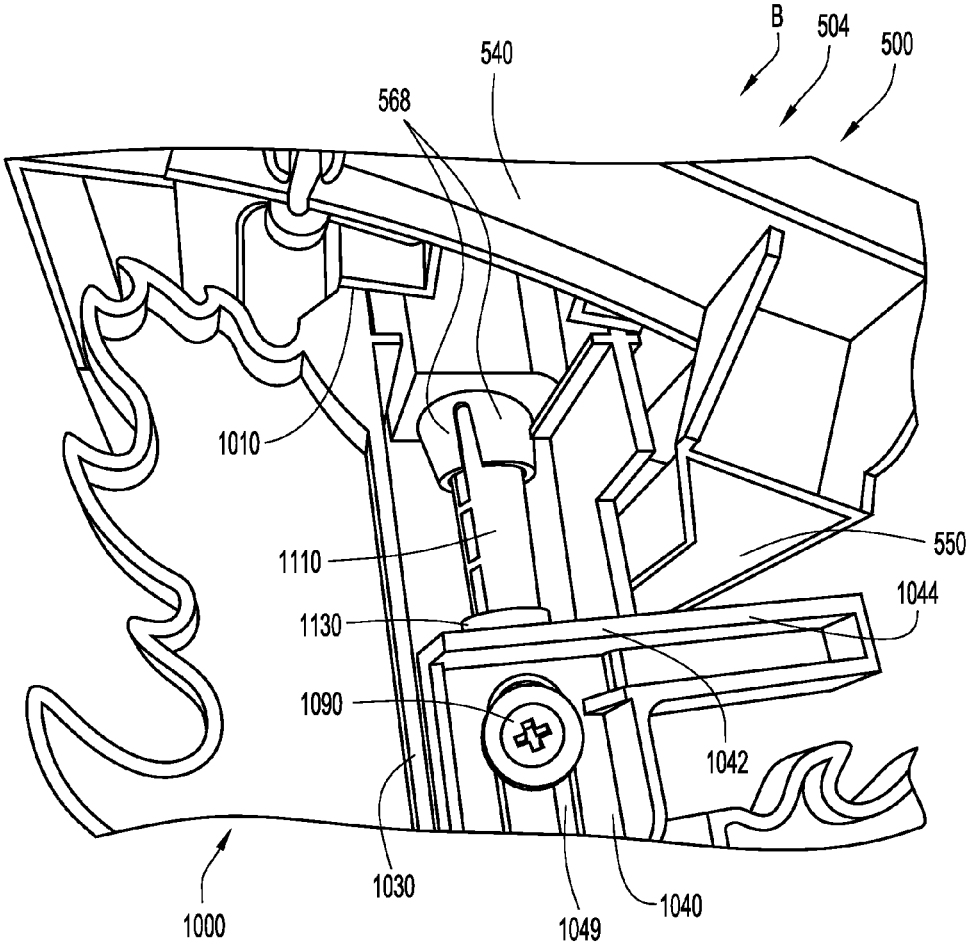
FIG. 20B illustrates a bottom view of the second embodiment of the top platform illustrated in FIG. 16A coupled to the top of the second embodiment of the pillar illustrated in FIG. 9, the bottom of the plunger illustrated in FIG. 18 being engaged with the top actuation plate of the pillar in a releasing configuration.

Illustrated in FIG. 18 is a plunger 1100. The plunger 1100 has a shaft 1110 with a proximal end 1120 and a distal end 1130. Disposed on the proximal end 1120 of the plunger 1100 is a handle 1122. Disposed on the distal end 1130 of the plunger 1100 is a flanged periphery 1132 (with a circumferential slot), which is configured to interact with the set of tabs 568 extending downwardly around the opening 566 from the bottom 504 of the top platform 500. Furthermore, disposed on the shaft 1110, between the proximal end 1120 and the distal end 1130 is an alignment member 1134. The alignment member 1134 is shaped identically to that of the opening 566, so that the plunger 1100 may be placed in the opening 566 on the top platform 500 in only one rotational orientation. The plunger 1100 is operatively coupled to the top platform 500 by inserting the distal end 1130 of the plunger through the opening 566 on the top portion 500, as illustrated in FIG. 19. As illustrated in FIGS. 19, 20A, and 20B, the distal end 1130 of the plunger 1100 extends below the set of tabs 568. The flanged periphery 1132 on the distal end 1130 of the plunger 1100 extends outwardly around the distal end 1130 of the plunger 1100 beyond the set of tabs 568, so that the distal end 1130 of the plunger 1100 cannot be pulled out of the opening 566 in the top platform 500. In other words, the set of tabs 568 on the top platform 500 and the flanged periphery 1134 on the distal end 1130 of the plunger 1100 lock the plunger 1100 into operative engagement with the top platform 500.

Turning to FIG. 19, illustrated is the top platform 500 coupled to the top 1010 of the pillar 1000. FIG. 19 illustrates that the protrusions 1012 that extend outwardly from the top 1010 of the pillar 1000 (see FIG. 17) are engaged by the first and second connection flanges 562, 564 to secure the top platform 500 to the pillar 1000. More specifically, the pillar 1000 is coupled to the central portion 560 of the top platform 500. Also illustrated in FIG. 19 is the plunger 1100 being inserted into the opening 566 on the central portion 560 of the top platform 500. The alignment member 1134 is positioned within the opening 566 on the central portion 560, and properly orients the plunger 1100 on the top platform 500.

Turning to FIGS. 20A and 20B, illustrated is the bottom 504 of the top platform 500 coupled to the top 1010 of the pillar 1000 and the top actuation plate 1040 in the internal cavity 1030 of the pillar 1000. As illustrated in FIG. 20A, the first and second pivotable members 530, 540, the top actuation plate 1040, and the plunger 1100 are illustrated in the retaining position A. The top actuation plate 1040 is positioned in the upper position, as described previously, where the screw 1090 is positioned in the lower portion of the slot 1049. The distal end 1130 of the plunger 1100 is engaged with the top 1042 of the top actuation plate 1040. Moreover, the front connector bar 550 is engaged with (resting on) the extension arm 1044, which retains the first and second pivotable members 530, 540 in the retaining position A described above.

As illustrated in FIG. 20B, the first and second pivotable members 530, 540, the top actuation plate 1040, and the plunger 1100 are illustrated in the releasing position B. The handle 1122, illustrated in FIG. 19, has been pushed downward so that the plunger 1100 is inserted farther into the opening 560. As illustrated in FIG. 20B, the distal end 1130 of the plunger 1100 is positioned farther from the set of tabs 568 than that illustrated in FIG. 20A. Because the distal end 1130 of the plunger 1100 is engaged with the top 1042 of the top actuation plate 1040, when the plunger 1100 is pushed downward, the top actuation plate 1040 is moved downward in the internal cavity 1030 to the lowered position where the screw 1090 is positioned in the top portion of the slot 1049. Furthermore, as the top actuation plate 1040 is moved to the lowered position, the extension arm 1044 is lowered until it is out of engagement with the front connector bar 550 of the first and second pivotable members 530, 540. The lowering of the extension arm 1044 enables the first and second pivotable members 530, 540 to pivot downward (via gravity) from the retaining position A to the releasing position B. In other embodiments, the front connector bar 550 may remain engaged with the extension arm 1044 when the extension arm 1044 is lowered, but the first and second pivotable members 530, 540 will still be able to pivot to the releasing position B.

In normal operation of the second embodiment of the toy vehicle play set 100, the resilient member 1050 biases the bottom actuation plate 1060 to the upper position, where the screws 1090 are positioned in the lower portion of the slots 1068. Because the top 1062 of the bottom actuation plate 1060 is engaged with the bottom 1046 of the top actuation plate 1040, the top actuation plate 1040 is also biased into the upper position, where the screws 1090 are positioned in the lower portion of the slots 1049 of the top actuation plate 1040. Furthermore, with the notches 1048, 1066 of the top and bottom actuation plates 1040, 1060 receiving the engagement bars 634 of the pivotable members 622 of the side platforms 600, and the top and bottom actuation plates 1040, 1060 being biased to the upper position, the pivotable members 622 of the side platforms 600 are biased in the retaining position A, illustrated in FIG. 12B. The top actuation plate 1040 being biased in the upper position biases the distal end 1030 of the plunger 1100 to the position where the distal end 1030 is proximate to the set of tabs 568. Moreover, the top actuation plate 1040 being biased in the upper position causes the first and second pivotable members 530, 540, which are engaged with the extension arm 1044 of the top actuation plate 1040 through the front connection member 560, to be biased in the retaining position A, as illustrated in FIGS. 16A and 20A.

When a user desires to launch toy vehicles 800 off of the top platform 500 or the side platforms 600, the user depresses the handle 1122 of the plunger 1100, causing the plunger 1100 to slide through a portion of the opening 566 on the top platform 500. The depression of the plunger 1100 causes a chain reaction of events, where the first and second pivotable members 530, 540 and the pivotable members 622 of the side platforms 600 pivot from the retaining position A to the releasing position B. Depression of the plunger 1100 causes the shaft 1110 of the plunger 1100 to slide through the opening 566 on the top platform 500, and causes the distal end 1130 of the plunger 1100 to push down on the top 1042 of the top actuation plate 1040. This causes the top actuation plate 1040 to move downward, which prompts the bottom 1046 of the top actuation plate 1040 to push down on the top 1062 of the bottom actuation plate 1060, resulting in the stretching or extension of the resilient member 1050 as the bottom actuation plate 1060 moves downward to the lowered position, as described previously. Because the notches 1048, 1066 of the top and bottom actuation plates 1040, 1060 receive the engagement bars 634 of the pivotable members 622 of the side platforms 600, when the top and bottom actuation plates 1040, 1060 are moved to the lowered positions, the pivotable members 622 of the side platforms 600 are pivoted into the releasing position B, illustrated in FIG. 12A. Furthermore, as the top actuation plate 1040 is lowered, the extension arm 1044 is lowered, causing the front connector bar 550 and the first and second pivotable members 530, 540 to pivot to the releasing position B, illustrated in FIG. 20B.

Thus, during operation of the second embodiment of the toy vehicle play set 100, the pivotable members 622 of the side platforms 600 and the first and second pivotable members 530, 540 of the top platform 500 are biased in the retaining position A. When the handle 1122 of the plunger 1100 is depressed, the pivotable members 622 of the side platforms 600 and the first and second pivotable members 530, 540 of the top platform 500 are simultaneously pivoted to the releasing position B. Once the force that depressed the handle 1122 of the plunger 1100 is removed, the pivotable members 622 of the side platforms 600 and the first and second pivotable members 530, 540 of the top platform 500 are simultaneously pivoted back to the retaining position A.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Therefore, although the disclosed inventions are illustrated and described herein as embodied in one or more specific examples, it is nevertheless not intended to be limited to the details shown, since various modifications and structural changes may be made therein without departing from the scope of the inventions. Further, various features from one of the embodiments may be incorporated into another of the embodiments. Accordingly, it is appropriate that the invention be construed broadly and in a manner consistent with the scope of the disclosure.

What is claimed is:

1. A play set for toy vehicles, comprising:

a base;

a support extending from the base, the support including a top and a bottom;

a first platform disposed on the support at a first height, the first platform configured to launch a toy vehicle in a first direction, the first platform including a first retaining mechanism movably coupled thereto, the first retaining mechanism being reconfigurable between a retaining configuration, in which a toy vehicle is prevented from rolling off of the first platform, and a releasing configuration, in which a toy vehicle is no longer prevented from rolling off of the first platform;

a second platform disposed on the support at a second height different than the first height, the second platform configured to launch a toy vehicle in a second direction different than the first direction, the second platform including a second retaining mechanism movably coupled thereto, the second retaining mechanism being reconfigurable between a retaining configuration, in which a toy vehicle is prevented from rolling off of the second platform, and a releasing configuration, in which a toy vehicle is no longer prevented from rolling off of the second platform; and an actuation member movably coupled to the support and engaged with the first retaining mechanism and the second retaining mechanism, wherein movement of the actuation member simultaneously moves the first retaining mechanism and the second retaining mechanism between their retaining configurations and their releasing configurations.

2. The play set for toy vehicles of claim 1, wherein the first platform includes a top, a bottom, a front end, a rear end, and at least one raised sidewall, and the second platform includes a top, a bottom, a front end, a rear end, and at least one raised sidewall.

3. The play set for toy vehicles of claim 2, wherein the first retaining mechanism is pivotally coupled to the bottom of the first platform, and the second retaining mechanism is pivotally coupled to the bottom of the second platform.

4. The play set for toy vehicles of claim 3, wherein the first retaining mechanism includes a tab that is substantially perpendicular to and extends substantially upward from the first retaining mechanism, at least a portion of the tab of the first retaining mechanism extends above the top of the first platform at a location proximate to the front end of the first platform.

5. The play set for toy vehicles of claim 4, wherein the second retaining mechanism includes a tab that is substantially perpendicular to and extends substantially upward from the second retaining mechanism, at least a portion of the tab of the second retaining mechanism extends above the top of the second platform at a location proximate to the front end of the second platform.

6. The play set for toy vehicles of claim 2, wherein the front end of the first platform is lower in height than the rear end of the first platform, and the front end of the second platform is lower in height than the rear end of the second platform.

7. The toy vehicle play set of claim 1, wherein the support includes an interior, and the actuation member is movably coupled to the interior of the support.

8. The toy vehicle play set of claim 1, further comprising a plunger movably coupled to the top of the support and in engagement with the actuation member.

9. The toy vehicle play set of claim 1, wherein the actuation member is movable between an uppermost position and a lowermost position, the first retaining mechanism and the second retaining mechanism are in their retaining configurations when the actuation member is in the uppermost position, and the first retaining mechanism and the second retaining mechanism are in their releasing configurations when the actuation member is in the lowermost position.

10. The toy vehicle play set of claim 9, wherein the actuation member is biased into the uppermost position by a resilient member.

11. The toy vehicle play set of claim 7, wherein the support further includes a first slot and a second slot, the first slot being disposed on the support proximate the first platform and the second slot being disposed on the support proximate the second platform.

12. The toy vehicle play set of claim 11, wherein the first retaining mechanism includes a first engagement bar that extends into the interior of the support through the first slot, and the second retaining mechanism includes a second engagement bar that extends into the interior of the support through the second slot.

13. The toy vehicle playset of claim 12, wherein the actuation member includes a first notch aligned with the first slot and configured to receive the first engagement bar of the first retaining mechanism, and a second notch aligned with the second slot and configured to receive the second engagement bar of the second retaining mechanism.

14. The you vehicle play set of claim 1, wherein the first platform is configured to be coupled to a first elongated track portion, and the second platform is configured to be coupled to a second elongated track portion.

* * * * *